US011498123B2

(12) United States Patent
Tamura et al.

(10) Patent No.: US 11,498,123 B2
(45) **Date of Patent: *Nov. 15, 2022**

(54) METAL POWDER FOR POWDER METALLURGY, COMPOUND, GRANULATED POWDER, SINTERED BODY, AND ORNAMENT

(71) Applicant: SEIKO EPSON CORPORATION, Tokyo (JP)

(72) Inventors: Takayuki Tamura, Hachinohe (JP); Hidefumi Nakamura, Hachinohe (JP)

(73) Assignee: SEIKO EPSON CORPORATION

( * ) Notice: Subject to any disclaimer, the term of this patent is extended or adjusted under 35 U.S.C. 154(b) by 774 days.

This patent is subject to a terminal disclaimer.

(21) Appl. No.: 15/542,294

(22) PCT Filed: Dec. 28, 2015

(86) PCT No.: PCT/JP2015/006499

§ 371 (c)(1),
(2) Date: Jul. 7, 2017

(87) PCT Pub. No.: WO2016/110929

PCT Pub. Date: Jul. 14, 2016

(65) Prior Publication Data

US 2018/0264547 A1 Sep. 20, 2018

(30) Foreign Application Priority Data

Jan. 8, 2015 (JP) ..... JP2015-002084
Dec. 25, 2015 (JP) ..... 2015-255353

(51) Int. Cl.
*B22F 1/10* (2022.01)
*B22F 1/102* (2022.01)
(Continued)

(52) U.S. Cl.
CPC ..... *B22F 1/142* (2022.01); *A47G 21/00* (2013.01); *B22F 1/0007* (2013.01); *B22F 1/10* (2022.01);
(Continued)

(58) Field of Classification Search
CPC .... B22F 1/0085; B22F 1/0059; B22F 1/0007; B22F 1/0062; B22F 2998/10;
(Continued)

(56) References Cited

U.S. PATENT DOCUMENTS 3,846,126 A 11/1974 Foley
4,089,682 A 5/1978 Saito et al.
(Continued)

FOREIGN PATENT DOCUMENTS

JP S52-85905 A 7/1977
JP S55-82744 A 6/1980
(Continued)

OTHER PUBLICATIONS

Schulz, Ultrafine Metal Powders for High Temperature Applications Made By Gas Atomization, pp. 74-84, 2001 (Year: 2001).*
(Continued)

*Primary Examiner* — Rebecca Janssen
(74) *Attorney, Agent, or Firm* — Harness, Dickey & Pierce, P.L.C.

(57) ABSTRACT

A metal powder for powder metallurgy contains Co as a principal component, Cr at 16 mass % or more and 35 mass % or less, and Si at 0.3 mass % or more and 2.0 mass % or less, wherein when one element selected from Ti, V, Y, Zr, Nb, Hf, and Ta is a first element, and one element selected from the group and having a higher group number in the periodic table than that of the first element or having the same group number in the periodic table as that of the first element and a higher period number than that of the first
(Continued)

element is a second element, the first element is at 0.01 mass % or more and 0.5 mass % or less, and the second element is at 0.01 mass % or more and 0.5 mass % or less.

9 Claims, 4 Drawing Sheets

(51) Int. Cl.

| | |
|---|---|
| ***B22F 1/00*** | (2022.01) |
| ***B22F 1/142*** | (2022.01) |
| ***C22C 19/07*** | (2006.01) |
| ***G04B 37/22*** | (2006.01) |
| ***C22C 1/04*** | (2006.01) |
| ***A47G 21/00*** | (2006.01) |
| ***B26B 3/02*** | (2006.01) |
| *B22F 1/065* | (2022.01) |

(52) U.S. Cl.
CPC ..... *B22F 1/102* (2022.01); *B26B 3/02* (2013.01); *C22C 1/04* (2013.01); *C22C 1/0433* (2013.01); *C22C 19/07* (2013.01); *G04B 37/22* (2013.01); *B22F 1/065* (2022.01); *B22F 2998/10* (2013.01)

(58) Field of Classification Search
CPC ..... B22F 1/0048; C22C 1/0433; C22C 1/04; C22C 19/07; A47G 21/00; B26B 3/02; G04B 37/22
See application file for complete search history.

(56) References Cited

U.S. PATENT DOCUMENTS

| | | | | |
|---|---|---|---|---|
| 4,147,538 | A | 4/1979 | Yajima et al. | |
| 4,668,290 | A * | 5/1987 | Wang | C22C 19/07 75/235 |
| 4,789,412 | A | 12/1988 | Nakamura et al. | |
| 5,242,758 | A | 9/1993 | Hitchcock et al. | |
| 5,602,197 | A | 2/1997 | Johnson et al. | |
| 5,710,384 | A | 1/1998 | Masuda | |
| 6,398,103 | B2 | 6/2002 | Hasz et al. | |
| 6,958,084 | B2 | 10/2005 | Whitaker et al. | |
| 2004/0033158 | A1 | 2/2004 | Chiba et al. | |
| 2006/0134454 | A1 | 6/2006 | Sathian et al. | |
| 2010/0008778 | A1 | 1/2010 | Patrick et al. | |
| 2011/0314965 | A1 | 12/2011 | Nakamura | |
| 2012/0282480 | A1 * | 11/2012 | Nishiyama | C23C 4/06 428/553 |
| 2014/0170433 | A1 | 6/2014 | Schick et al. | |
| 2015/0000468 | A1 | 1/2015 | Nakamura | |
| 2015/0273581 | A1 | 10/2015 | Nakamura | |
| 2016/0168662 | A1 * | 6/2016 | Hardy | C22C 1/0433 420/438 |
| 2018/0264547 | A1 | 9/2018 | Tamura et al. | |
| 2019/0003017 | A1 | 1/2019 | Gindorf et al. | |

FOREIGN PATENT DOCUMENTS

| | | | | |
|---|---|---|---|---|
| JP | 62-009172 | B2 | | 2/1987 |
| JP | H03-146631 | A | | 6/1991 |
| JP | H06-279913 | A | | 10/1994 |
| JP | H07-224337 | A | | 8/1995 |
| JP | H07-300643 | A | | 11/1995 |
| JP | H08-302463 | A | | 11/1996 |
| JP | 10-204564 | A | | 8/1998 |
| JP | 11-277669 | A | | 10/1999 |
| JP | 2007-177675 | A | | 7/2007 |
| JP | 2008-001942 | A | | 1/2008 |
| JP | 2009-138259 | A | | 6/2009 |
| JP | 2009138259 | A | * | 6/2009 |
| JP | 2010-150587 | A | | 7/2010 |
| JP | 2011-214097 | A | | 10/2011 |
| JP | 2012-087416 | A | | 5/2012 |
| JP | 2015-183277 | A | | 10/2015 |
| JP | 2016130364 | A | | 7/2016 |
| JP | 2016183401 | A | | 10/2016 |

OTHER PUBLICATIONS

Garg et al., "Sensor and Actuator Needs for more Intelligent Gas Turbine Engines," NASA, GT2010-22685, Jul. 2010. (Year: 2010).

* cited by examiner

METAL POWDER FOR POWDER METALLURGY, COMPOUND, GRANULATED POWDER, SINTERED BODY, AND ORNAMENT

CROSS REFERENCE TO RELATED APPLICATIONS

This application is a U.S. National Phase Application under 35 U.S.C. 371 of International Application No. PCT/JP2015/006499 filed on Dec. 28, 2015 and published in Japanese as WO 2016/0110929 A1 on Jul. 14, 2016. This application claims priority to Japanese Patent Application No. 2015-002084 filed Jan. 8, 2015 and Japanese Patent Application No. 2015-255353 filed Dec. 25, 2015. The entire disclosures of all of the above applications are incorporated herein by reference.

TECHNICAL FIELD

The present invention relates to a metal powder for powder metallurgy, a compound, a granulated powder, a sintered body, and an ornament.

BACKGROUND ART

In a powder metallurgy method, a composition containing a metal powder and a binder is molded into a desired shape to obtain a molded body, and the obtained molded body is degreased and sintered, whereby a sintered body is produced. In such a process for producing a sintered body, an atomic diffusion phenomenon occurs among particles of the metal powder, whereby the molded body is gradually densified, resulting in sintering.

For example, JP-A-2012-87416 proposes a metal powder for powder metallurgy which contains Zr and Si, with the remainder including at least one element selected from the group consisting of Fe, Co, and Ni, and unavoidable elements. According to such a metal powder for powder metallurgy, the sinterability is improved by the action of Zr, whereby a sintered body having a high density can be easily produced.

Further, for example, JP-A-6-279913 discloses a composition for metal injection molding containing 100 parts by weight of a stainless steel powder composed of C (0.03 wt % or less), Ni (8 to 32 wt %), Cr (12 to 32 wt %), and Mo (1 to 7 wt %), with the remainder including Fe and unavoidable impurities, and 0.1 to 5.5 parts by weight of at least one type of powder composed of Ti or/and Nb and having an average particle diameter of 10 to 60 μm. By using such a composition obtained by mixing two types of powders, a sintered body having a high sintered density and excellent corrosion resistance is obtained.

Further, for example, JP-A-2007-177675 discloses a needle seal for a needle valve, which has a composition containing C (0.95 to 1.4 mass %), Si (1.0 mass % or less), Mn (1.0 mass % or less), Cr (16 to 18 mass %), and Nb (0.02 to 3 mass %), with the remainder including Fe and unavoidable impurities, has a density after sintering of 7.65 to 7.75 g/cm$^3$, and is obtained by molding using a metal injection molding method. According to this, a needle seal having a high density is obtained.

The thus obtained sintered body is getting widely used for various machine components, structural components, etc. recently.

However, depending on the use of a sintered body, further densification is needed in some cases. In such a case, a sintered body is further subjected to an additional treatment such as a hot isostatic pressing treatment (HIP treatment) to increase the density, however, the workload is significantly increased, and also an increase in the cost is inevitable.

Therefore, an expectation for realization of a metal powder capable of producing a sintered body having a high density without performing an additional treatment or the like has increased.

SUMMARY OF INVENTION

Technical Problem

An object of the invention is to provide a metal powder for powder metallurgy, a compound, and a granulated powder, each of which is capable of producing a sintered body having a high density, and a sintered body and an ornament, each of which is produced using the metal powder for powder metallurgy and has a high density.

Solution to Problem

The above object is achieved by the following invention.

A metal powder for powder metallurgy of the invention contains Co as a principal component, Cr in a proportion of 16 mass % or more and 35 mass % or less, and Si in a proportion of 0.3 mass % or more and 2.0 mass % or less, wherein when one element selected from the group consisting of Ti, V, Y, Zr, Nb, Hf, and Ta is defined as a first element, and one element selected from the group and having a higher group number in the periodic table than that of the first element or having the same group number in the periodic table as that of the first element and a higher period number in the periodic table than that of the first element is defined as a second element, the first element is contained in a proportion of 0.01 mass % or more and 0.5 mass % or less, and the second element is contained in a proportion of 0.01 mass % or more and 0.5 mass % or less.

According to this configuration, the alloy composition is optimized so that the densification during sintering of the metal powder for powder metallurgy can be enhanced. As a result, a metal powder for powder metallurgy capable of producing a sintered body having a high density is obtained without performing an additional treatment.

In the metal powder for powder metallurgy of the invention, it is preferred that further Mo is contained in a proportion of 3 mass % or more and 12 mass % or less.

According to this configuration, the corrosion resistance of a sintered body can be further enhanced.

In the metal powder for powder metallurgy of the invention, it is preferred that further N is contained in a proportion of 0.09 mass % or more and 0.5 mass % or less.

According to this configuration, the toughness and impact resistance of a sintered body can be further enhanced.

In the metal powder for powder metallurgy of the invention, it is preferred that when a value obtained by dividing the content E2 of the second element by the mass number of the second element is represented by X2 and a value obtained by dividing the content E1 of the first element by the mass number of the first element is represented by X1, X1/X2 is 0.3 or more and 3 or less.

According to this configuration, when the metal powder for powder metallurgy is fired, a difference in timing between the deposition of a carbide or the like of the first element and the deposition of a carbide or the like of the second element can be optimized. As a result, pores remaining in a molded body can be eliminated as if they were swept out sequentially from the inside, and therefore, pores generated in the sintered body can be minimized. Accordingly, a metal powder for powder metallurgy capable of producing a sintered body having a high density and excellent sintered body properties is obtained.

In the metal powder for powder metallurgy of the invention, it is preferred that the sum of the content of the first element and the content of the second element is 0.05 mass % or more and 0.6 mass % or less.

According to this configuration, the densification of a sintered body to be produced becomes necessary and sufficient.

In the metal powder for powder metallurgy of the invention, it is preferred that the metal powder has an average particle diameter of 0.5 μm or more and 30 μm or less.

According to this configuration, pores remaining in a sintered body are extremely decreased, and therefore, a sintered body having a particularly high density and particularly excellent mechanical properties can be produced.

A compound of the invention includes the metal powder for powder metallurgy of the invention and a binder which binds the particles of the metal powder for powder metallurgy to one another.

According to this configuration, a compound capable of producing a sintered body having a high density is obtained.

A granulated powder of the invention includes the metal powder for powder metallurgy of the invention which is granulated.

According to this configuration, a granulated powder capable of producing a sintered body having a high density is obtained.

A sintered body of the invention contains Co as a principal component, Cr in a proportion of 16 mass % or more and 35 mass % or less, and Si in a proportion of 0.3 mass % or more and 2.0 mass % or less, wherein when one element selected from the group consisting of Ti, V, Y, Zr, Nb, Hf, and Ta is defined as a first element, and one element selected from the group and having a higher group number in the periodic table than that of the first element or having the same group number in the periodic table as that of the first element and a higher period number in the periodic table than that of the first element is defined as a second element, the first element is contained in a proportion of 0.01 mass % or more and 0.5 mass % or less, and the second element is contained in a proportion of 0.01 mass % or more and 0.5 mass % or less.

According to this configuration, a sintered body having a high density is obtained without performing an additional treatment.

An ornament of the invention includes a region constituted by the sintered body of the invention.

According to this configuration, a sintered body having a high density is obtained without performing an additional treatment.

The ornament of the invention is preferably an exterior component for a timepiece.

According to this configuration, an exterior component for a timepiece having a high density is obtained without performing an additional treatment.

The ornament of the invention is preferably a personal ornament.

According to this configuration, a personal ornament having a high density is obtained without performing an additional treatment.

The ornament of the invention is preferably an eating utensil.

According to this configuration, an eating utensil having a high density is obtained without performing an additional treatment.

DESCRIPTION OF EMBODIMENTS

Figure 1:
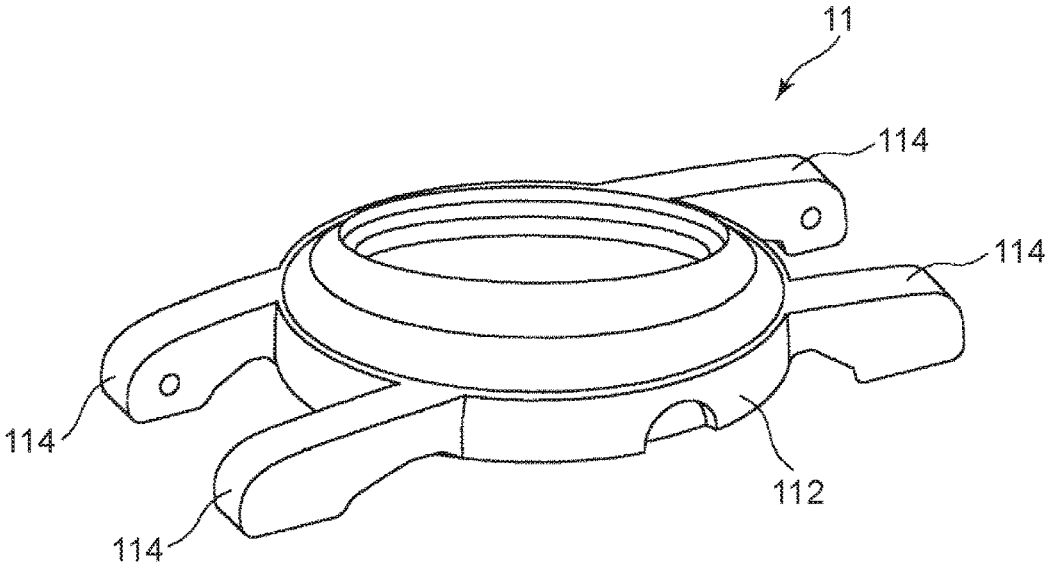
FIG. 1 is a perspective view showing a watch case to which an embodiment of an ornament of the invention is applied.

Hereinafter, a metal powder for powder metallurgy, a compound, a granulated powder, a sintered body, and an ornament of the invention will be described in detail.

[Metal Powder for Powder Metallurgy]

First, a metal powder for powder metallurgy of the invention will be described.

In powder metallurgy, a sintered body having a desired shape can be obtained by molding a composition containing a metal powder for powder metallurgy and a binder into a desired shape, followed by degreasing and sintering. According to such a powder metallurgy technique, an advantage that a sintered body with a complicated and fine shape can be produced in a near-net shape (a shape close to a final shape) as compared with the other metallurgy techniques is obtained.

With respect to the metal powder for powder metallurgy to be used in the powder metallurgy, an attempt to increase the density of a sintered body to be produced by appropriately changing the composition thereof has been made. However, in the sintered body, pores are liable to be generated, and therefore, in order to obtain mechanical properties comparable to those of ingot materials, it was necessary to further increase the density of the sintered body.

Therefore, in the past, the obtained sintered body was further subjected to an additional treatment such as a hot isostatic pressing treatment (HIP treatment) to increase the density in some cases. However, such an additional treatment requires much time, labor, and cost, and therefore becomes an obstacle to the expansion of the application of the sintered body.

In consideration of the above-mentioned problems, the present inventors have made intensive studies to find conditions for obtaining a sintered body having a high density without performing an additional treatment. As a result, they found that the density of a sintered body can be increased by optimizing the composition of an alloy which forms a metal powder, and thus completed the invention.

Specifically, the metal powder for powder metallurgy of the invention is a metal powder which contains Cr in a proportion of 16 mass % or more and 35 mass % or less, Si in a proportion of 0.3 mass % or more and 2.0 mass % or less, the below-mentioned first element in a proportion of 0.01 mass % or more and 0.5 mass % or less, and the below-mentioned second element in a proportion of 0.01 mass % or more and 0.5 mass % or less, with the remainder including Co and other elements. According to such a metal powder, as a result of optimizing the alloy composition, the densification during sintering can be particularly enhanced. As a result, a sintered body having a high density can be produced without performing an additional treatment.

Then, by increasing the density of a sintered body, a sintered body having excellent mechanical properties is obtained. Such a sintered body can be widely applied also to, for example, machine components, structural components, and the like, to which an external force (load) is applied.

Incidentally, the first element is one element selected from the group consisting of the following seven elements: Ti, V, Y, Zr, Nb, Hf, and Ta, and the second element is one element selected from the group consisting of the above-mentioned seven elements and having a higher group number in the periodic table than that of the first element or one element selected from the group consisting of the above-mentioned seven elements and having the same group number in the periodic table as that of the element selected as the first element and a higher period number in the periodic table than that of the first element.

Hereinafter, the alloy composition of the metal powder for powder metallurgy of the invention will be described in further detail. Incidentally, in the following description, the "metal powder for powder metallurgy" is sometimes simply referred to as "metal powder".

(Cr)

Cr (chromium) is an element which imparts corrosion resistance to a sintered body to be produced, and by using a metal powder containing Cr, a sintered body which can maintain high mechanical properties over a long period of time is obtained. Due to this, for example, even if the obtained sintered body is in contact with the skin, metal ions are less likely to be eluted, and therefore, the biocompatibility can be further enhanced.

The content of Cr in the metal powder is set to 16 mass % or more and 35 mass % or less, but is set to preferably 27 mass % or more and 34 mass % or less, more preferably 28 mass % or more and 33 mass % or less. If the content of Cr is less than the above lower limit, the corrosion resistance of a sintered body to be produced is insufficient depending on the overall composition. On the other hand, if the content of Cr exceeds the above upper limit, the sinterability is deteriorated depending on the overall composition, and therefore, it becomes difficult to increase the density of the sintered body.

(Mo)

The metal powder for powder metallurgy of the invention may contain Mo (molybdenum) as needed.

Mo is an element which acts to further enhance the corrosion resistance of a sintered body to be produced. That is, by the addition of Mo, corrosion resistance imparted by the addition of Cr can be further enhanced. This is considered to be because by adding Mo, a passivation film containing an oxide of Cr as a main material is further densified. Accordingly, a sintered body produced using the metal powder to which Mo is added is further less likely to elute metal ions, and therefore, the biocompatibility can be further enhanced.

The content of Mo in the metal powder is set to preferably 3 mass % or more and 12 mass % or less, more preferably 4 mass % or more and 11 mass % or less, further more preferably 5 mass % or more and 9 mass % or less. If the content of Mo is less than the above lower limit, the amount of Mo with respect to the amount of Cr or Si is relatively too large depending on the content of Cr or Si so as to lose the balance of the elements contained, and therefore, the mechanical properties of the sintered body may be deteriorated.

(Si)

Si (silicon) is an element which acts to enhance the mechanical properties of a sintered body to be produced. By the addition of Si, in an alloy, part of Si is oxidized to form a silicon oxide. Examples of the silicon oxide include SiO and $SiO_2$. Such a silicon oxide suppresses a significant increase in the size of a metal crystal when the metal crystal grows during the sintering of the metal powder. Due to this, in an alloy to which Si is added, the particle diameter of the metal crystal is kept small, and thus, the mechanical properties of the sintered body can be further enhanced. In particular, by the substitution of a Si atom with a Co atom as a substitutional element, the crystal structure is slightly distorted, so that the Young's modulus is increased. Therefore, by the addition of Si, excellent mechanical properties, particularly an excellent Young's modulus can be obtained. As a result, a sintered body having higher deformation resistance is obtained.

The content of Si in the metal powder is set to 0.3 mass % or more and 2.0 mass % or less, but is preferably 0.5 mass % or more and 1.0 mass % or less, more preferably 0.6 mass % or more and 0.9 mass % or less. If the content of Si is less than the above lower limit, the amount of silicon oxide is too small depending on the firing conditions, and therefore, the size of a metal crystal may be liable to be increased during the sintering of the metal powder. On the other hand, if the content of Si exceeds the above upper limit, the amount of silicon oxide is too large depending on the firing conditions, and therefore, a region where silicon oxide is continuously distributed in a space is liable to be generated. In this region, the possibility of decreasing the mechanical properties is high.

Further, part of Si preferably exists in the form of silicon oxide as described above, however, as for the existing amount thereof, the ratio of Si contained as silicon oxide to the total amount of Si is preferably 10 mass % or more and 90 mass % or less, more preferably 20 mass % or more and 80 mass % or less, further more preferably 30 mass % or more and 70 mass % or less, and particularly preferably 35 mass % or more and 65 mass % or less. By setting the ratio of Si contained as silicon oxide to the total amount of Si within the above range, an effect of improving the mechanical properties as described above is brought about to the sintered body, and also by the existence of a given amount of silicon oxide, the amount of oxides of transition metal elements such as Co, Cr, and Mo contained inside the sintered body can be sufficiently kept low. It is considered that this is namely because Si is more easily oxidized than Co, Cr, and Mo and deprives oxygen bonded to these transition metal elements so as to be able to cause a reduction reaction, and therefore, the fact that not the total amount of Si is silicon oxide means that a sufficient reduction reaction is caused for the transition metal elements. Accordingly, by setting the ratio of Si contained as silicon oxide to the total amount of Si within the above range, in the sintered body, the effect such as high mechanical properties as described above is prevented from being inhibited by an oxide of Co, Cr, or Mo. As a result, a sintered body having higher reliability is realized.

In addition, a given amount of silicon oxide is considered to contribute to the formation of a chemically stable film on the surface of the sintered body along with chromium oxide or molybdenum oxide. Due to this, chemical stability is imparted to the surface of the sintered body, and thus, the corrosion resistance of the sintered body is further enhanced.

Further, by setting the ratio of Si contained as silicon oxide to the total amount of Si within the above range, an appropriate hardness is given to the sintered body. That is, it is considered that by the existence of a given amount of Si which is not in the form of silicon oxide, Si and at least one element selected from Co, Cr, and Mo form a hard intermetallic compound, which increases the hardness of the sintered body. By the increase in the hardness of the sintered body, the durability and wear resistance can be enhanced.

This intermetallic compound is not particularly limited, however, examples thereof include $CoSi_2$, $Cr_3Si$, $MoSi_2$, and $Mo_5Si_3$.

Incidentally, in consideration of the deposition amount of the intermetallic compound, the ratio of the content of Si to the content of Mo (Si/Mo) is preferably 0.05 or more and 0.2 or less, more preferably 0.08 or more and 0.15 or less in terms of mass ratio. According to this, higher mechanical properties (for example, a favorable balance between hardness and toughness) can be imparted to the sintered body.

Further, silicon oxide may be distributed at any place, but is preferably distributed in a segregated manner at the grain boundary (the boundary surface between metal crystals). By segregating silicon oxide at such a place, an increase in the size of a metal crystal is more reliably suppressed, and thus, a sintered body having more excellent mechanical properties is obtained. Further, deposits of silicon oxide segregated at the grain boundary keep a proper distance from one another by themselves, and therefore, the deposits of silicon oxide can be more uniformly dispersed in the sintered body. As a result, the probability that silicon oxide is continuously distributed in a space is decreased, and thus, a decrease in the mechanical properties due to such silicon oxide can be avoided.

Further, with respect to the segregated deposits of silicon oxide, the size, distribution, and the like thereof can be specified by an area analysis of a qualitative analysis. Specifically, in a compositional image of Si obtained by an electron beam microanalyzer (EPMA), an average diameter of a region where Si is segregated is preferably 0.1 μm or more and 10 μm or less, more preferably 0.3 μm or more and 8 μm or less. When the average diameter of the region where Si is segregated is within the above range, the size of the deposit of silicon oxide becomes most suitable for exhibiting the respective effects as described above. That is, if the average diameter of the region where Si is segregated is less than the above lower limit, the deposits of silicon oxide are not segregated to a sufficient size, and the above-mentioned respective effects may not be sufficiently obtained. On the other hand, if the average diameter of the region where Si is segregated exceeds the above upper limit, the mechanical properties of the sintered body may be deteriorated.

Incidentally, the average diameter of the region where Si is segregated can be determined as the average of the diameter of a circle having the same area (projected area circle equivalent diameter) as that of the region where Si is segregated in the compositional image of Si.

A sintered body produced using the metal powder for powder metallurgy of the invention includes a first phase composed mainly of Co and a second phase composed mainly of $Co_3Mo$. By including the second phase of these phases, an appropriate hardness is imparted to the sintered body in the same manner as the intermetallic compound containing Si described above. On the other hand, in the case where the second phase is included excessively, the second phase is liable to be segregated significantly, and therefore, the mechanical properties may be deteriorated.

Therefore, it is preferred that the first phase and the second phase are included at an appropriate ratio from the above viewpoint. Specifically, for the sintered body, a crystal structure analysis is performed by X-ray diffractometry using a Cu-Kα ray, and when the height of the highest peak among the peaks derived from Co is assumed to be 1, the height of the highest peak among the peaks derived from $Co_3Mo$ is preferably 0.01 or more and 0.5 or less, more preferably 0.02 or more and 0.4 or less.

Further, if the ratio of the height of the peak of $Co_3Mo$ when the height of the peak of Co is assumed to be 1 is less than the above lower limit, the ratio of $Co_3Mo$ to Co in the sintered body is decreased depending on the composition of the alloy, and therefore, the hardness may be decreased. On the other hand, if the ratio of the height of the peak of $Co_3Mo$ exceeds the above upper limit, the existing amount of $Co_3Mo$ is too large depending on the composition of the alloy, and therefore, $Co_3Mo$ is liable to be significantly segregated so that the mechanical properties of the sintered body may be deteriorated.

Incidentally, the Cu-Kα ray is generally a characteristic X-ray with an energy of 8.048 keV.

Further, when a peak derived from Co is identified, the identification is performed based on the database of Co of ICDD (The International Centre for Diffraction Data) card. Similarly, when a peak derived from $Co_3Mo$ is identified, the identification is performed based on the database of $Co_3Mo$ of ICDD card.

Further, in the sintered body, the existing ratio of $Co_3Mo$ is preferably 0.01 mass % or more and 10 mass % or less, more preferably 0.05 mass % or more and 5 mass % or less. According to this, a sintered body having both high hardness and high mechanical properties (toughness and the like) is obtained.

Incidentally, such an existing ratio is obtained by quantifying the existing ratio of $Co_3Mo$ from the results of a crystal structure analysis.

Here, the dendrite phase is a dendritically grown crystal structure, and if a large amount of such a dendrite phase is contained, the mechanical properties of the sintered body are deteriorated. Therefore, the reduction of the content of the dendrite phase is effective in the enhancement of the mechanical properties of the sintered body. Specifically, the cross section of the sintered body is observed with a scanning electron microscope, and in the obtained observation image, the ratio of the area occupied by the dendrite phase is preferably 20% or less, more preferably 10% or less. The sintered body satisfying such conditions has particularly excellent mechanical properties.

Further, the volume of each particle of the metal powder is very small, and therefore, when production is performed from a molten state, the cooling rate is high and also the cooling uniformity is high. Due to this, in the sintered body produced from such a metal powder, the formation of a dendrite phase is suppressed. On the other hand, in the case of a method such as casting, forging, or rolling, when a molten metal is cooled, a volume to be cooled is large, and therefore, a cooling rate is low and also the cooling uniformity is low. As a result, it is considered that in the sintered body produced by such a method, relatively many dendrite phases are formed.

Incidentally, the area ratio described above is calculated as a ratio of the area occupied by the dendrite phase to the area of the observation image, and the length of one side of the observation image is set to about 50 μm or more and 1000 μm or less.

(N)

The metal powder for powder metallurgy of the invention may contain N (nitrogen) as needed.

N is an element which acts to enhance the mechanical properties of a sintered body to be produced. N is an austenitizing element and therefore acts to enhance the toughness by accelerating the austenitization of the crystal structure of the sintered body.

Further, by including N, the formation of a dendrite phase in the sintered body is suppressed, and the content of the dendrite phase becomes very low. Therefore, also from this viewpoint, the toughness can be enhanced.

Accordingly, the sintered body to be obtained not only has an appropriate hardness, but also has high toughness and has a low dendrite phase content. Due to this, such a sintered body also has high impact resistance and the like.

The content of N in the metal powder is preferably 0.09 mass % or more and 0.5 mass % or less, more preferably 0.12 mass % or more and 0.4 mass % or less, further more preferably 0.14 mass % or more and 0.25 mass % or less, and particularly preferably 0.15 mass % or more and 0.22 mass % or less. If the content of N is less than the above lower limit, the austenitization of the crystal structure of the sintered body is insufficient depending on the composition of the alloy so that the toughness of the sintered body may be liable to be deteriorated. This is considered to be because in the sintered body, an hcp structure (ε phase) is deposited excessively. On the other hand, if the content of N exceeds the above upper limit, various nitrides may be formed in a large amount depending on the composition of the alloy and also the composition may be difficult to sinter. Therefore, the sintered density of the sintered body is decreased, and the corrosion resistance or mechanical properties may be deteriorated. Examples of the nitride to be formed include $Cr_2N$.

In particular, when the content of N is within the range of 0.15 mass % or more and 0.22 mass % or less, the austenite phase becomes particularly dominant, and a significant improvement of the toughness is observed with a decrease in the hardness. When the sintered body produced using the metal powder containing N at a content within such a range is subjected to a crystal structure analysis by X-ray diffractometry using a Cu-Kα ray, a very strong main peak derived from the austenite phase is observed. On the other hand, the heights of the peak derived from the hcp structure and the other peaks are all 5% or less of the height of the main peak. This proves that the austenite phase is dominant.

Further, the ratio of the content of N to the content of Si (N/Si) is preferably 0.1 or more and 0.8 or less, more preferably 0.2 or more and 0.6 or less in terms of mass ratio. According to this, high mechanical properties and high corrosion resistance can be both achieved in the sintered body. That is, by the addition of an appropriate amount of Si, an appropriate amount of silicon oxide is formed, and the amount of oxides of Co, Cr, and Mo is decreased, and therefore, the mechanical properties are enhanced as described above, and also the corrosion resistance on the surface is further enhanced. On the other hand, if the addition amount of Si is too large, the production amount of silicon oxide is increased excessively, and therefore, the mechanical properties of the sintered body may be deteriorated. Therefore, by the addition of N at a ratio within the above range, both of the high corrosion resistance by the addition of Si and the above-mentioned effect by the addition of N can be exhibited without cancelling each other out. This is considered to be because while Si and a metal element such as Co form a substitutional solid solution, N and a metal element such as Co form an interstitial solid solution, and therefore, these elements can coexist with each other. Moreover, it is considered that this is also due to the fact that the distortion of the crystal structure caused by solid solution of Si is suppressed by the solid solution of N, and thus, the decrease in the mechanical properties is prevented.

Further, by the addition of Si, the crystal structure is distorted as described above, however, in this state, a hysteresis is liable to occur in the behavior of thermal expansion and thermal shrinkage. If a large hysteresis is present in the behavior of thermal expansion and thermal shrinkage, the thermal properties of the sintered body may change over time.

On the other hand, by the addition of N at a ratio within the above range, N penetrates into the crystal structure and is solid-dissolved therein, and therefore, the distortion of the crystal structure is suppressed. As a result, a hysteresis in the behavior of thermal expansion and thermal shrinkage is prevented, and thus, the stabilization of the thermal properties of the sintered body can be achieved.

Accordingly, by the addition of appropriate amounts of Si and N, stabilization of mechanical properties and stabilization of thermal properties of the sintered body can be both achieved.

Incidentally, if the ratio of the content of N to the content of Si is lower than the above lower limit, the distortion of the crystal structure cannot be sufficiently suppressed depending on the composition of the alloy, so that the toughness or the like may be deteriorated. On the other hand, if the ratio exceeds the above upper limit, the composition is difficult to sinter depending on the composition of the alloy, so that the sintered density of the sintered body is decreased, and also the mechanical properties may be deteriorated.

(C)

The metal powder for powder metallurgy of the invention may contain C (carbon) as needed.

C is an element which acts to enhance the mechanical properties of a sintered body to be produced. By the addition of C, the hardness and tensile strength of the sintered body are further enhanced. Further, also by binding this C to the first element or the second element to form a carbide, the mechanical properties of the sintered body are improved.

The content of C in the metal powder is preferably 1.5 mass % or less, more preferably 0.7 mass % or less. If the content of C exceeds the above upper limit, the brittleness of the sintered body is increased depending on the composition of the alloy, and the mechanical properties may be deteriorated.

Further, the lower limit of the addition amount of C is not particularly set, however, the lower limit is preferably set to about 0.05 mass % so as to sufficiently exhibit the above-mentioned effect.

Further, the content of C is preferably about 0.02 times or more and 0.5 times or less, more preferably about 0.05 times or more and 0.3 times or less the content of Si. By setting the ratio of C to Si within the above range, the adverse effect of silicon oxide or a carbide on the hardness or the mechanical properties of the sintered body can be minimized.

Further, the content of N is preferably about 0.3 times or more and 10 times or less, more preferably about 2 times or more and 8 times or less the content of C. By setting the ratio of N to C within the above range, the balance between the hardness and the mechanical properties of the sintered body can be optimized.

(First Element and Second Element)

The first element and the second element each deposit a carbide or an oxide (hereinafter also collectively referred to as "carbide or the like") in the alloy by binding to oxygen or the like contained in the binder or the metal powder in the molded body. It is considered that this deposited carbide or the like inhibits the significant growth of crystal grains when the metal powder is sintered. As a result, as described above, it becomes difficult to generate pores in a sintered body, and also the increase in the size of crystal grains is prevented, and thus, a sintered body having a high density and excellent mechanical properties is obtained.

In addition, although a detailed description will be given later, the deposited carbide or the like promotes the accumulation of silicon oxide at a crystal grain boundary, and as a result, the sintering is promoted and the density is increased while suppressing the increase in the size of crystal grains.

Incidentally, the first element and the second element are two elements selected from the group consisting of the following seven elements: Ti, V, Y, Zr, Nb, Hf, and Ta, but preferably include an element belonging to group IIIA or group IVA in the long periodic table (Ti, Y, Zr, or Hf). By including an element belonging to group IIIA or group IVA as at least one of the first element and the second element, oxygen contained as an oxide in the metal powder is removed and the sinterability of the metal powder can be particularly enhanced.

Further, the first element is only required to be one element selected from the group consisting of the following seven elements: Ti, V, Y, Zr, Nb, Hf, and Ta as described above, but is preferably an element belonging to group IIIA or group IVA in the long periodic table in the group consisting of the above-mentioned seven elements. An element belonging to group IIIA or group IVA removes oxygen contained as an oxide in the metal powder and therefore can particularly enhance the sinterability of the metal powder. According to this, the concentration of oxygen remaining in the crystal grains after sintering can be decreased. As a result, the content of oxygen in the sintered body can be decreased, and the density can be increased. Further, these elements are elements having high activity, and therefore are considered to cause rapid atomic diffusion. Accordingly, this atomic diffusion acts as a driving force, and thereby a distance between particles of the metal powder is efficiently decreased and a neck is formed between the particles, so that the densification of a molded body is promoted. As a result, the density of the sintered body can be further increased.

On the other hand, the second element is only required to be one element selected from the group consisting of the following seven elements: Ti, V, Y, Zr, Nb, Hf, and Ta and different from the first element as described above, but is preferably an element belonging to group VA in the long periodic table in the group consisting of the above-mentioned seven elements. An element belonging to group VA particularly efficiently deposits the above-mentioned carbide or the like, and therefore, can efficiently inhibit the significant growth of crystal grains during sintering. As a result, the formation of fine crystal grains is promoted, and thus, the density of the sintered body can be increased and also the mechanical properties of the sintered body can be enhanced.

Incidentally, by the combination of the first element with the second element composed of the elements as described above, the effects of the respective elements are exhibited without inhibiting each other. Due to this, the metal powder containing such a first element and a second element enables the production of a sintered body having a particularly high density.

Further, more preferably, a combination in which the first element is an element belonging to group IVA and the second element is Nb is adopted.

Further, more preferably, a combination in which the first element is Zr or Hf and the second element is Nb is adopted.

By adopting such a combination, the above-mentioned effect becomes more prominent.

Further, among these elements, Zr is a ferrite forming element, and therefore deposits a body-centered cubic lattice phase. This body-centered cubic lattice phase has more excellent sinterability than the other crystal lattice phases, and therefore contributes to the densification of a sintered body.

The content of the first element in the metal powder is set to 0.01 mass % or more and 0.5 mass % or less, but is set to preferably 0.03 mass % or more and 0.2 mass % or less, more preferably 0.05 mass % or more and 0.1 mass % or less. If the content of the first element is less than the above lower limit, the effect of the addition of the first element is weakened depending on the overall composition so that the densification of a sintered body to be produced is insufficient. On the other hand, if the content of the first element exceeds the above upper limit, the amount of the first element is too large depending on the overall composition so that the ratio of the above-mentioned carbide or the like is too high, and therefore, the densification is deteriorated instead.

The content of the second element in the metal powder is set to 0.01 mass % or more and 0.5 mass % or less, but is set to preferably 0.03 mass % or more and 0.2 mass % or less, more preferably 0.05 mass % or more and 0.1 mass % or less. If the content of the second element is less than the above lower limit, the effect of the addition of the second element is weakened depending on the overall composition so that the densification of a sintered body to be produced is insufficient. On the other hand, if the content of the second element exceeds the above upper limit, the amount of the second element is too large depending on the overall composition so that the ratio of the above-mentioned carbide or the like is too high, and therefore, the densification is deteriorated instead.

Further, as described above, each of the first element and the second element deposits a carbide or the like, however, in the case where an element belonging to group IIIA or group IVA is selected as the first element as described above and an element belonging to group VA is selected as the second element as described above, it is presumed that when the metal powder is sintered, the timing when a carbide or the like of the first element is deposited and the timing when a carbide or the like of the second element is deposited differ from each other. It is considered that due to the difference in timing when a carbide or the like is deposited in this manner, sintering gradually proceeds so that the generation of pores is prevented, and thus, a dense sintered body is obtained. That is, it is considered that by the existence of both of the carbide or the like of the first element and the carbide or the like of the second element, the increase in the size of crystal grains can be suppressed while increasing the density of the sintered body.

Incidentally, the metal powder is only required to contain two elements selected from the group consisting of the above-mentioned seven elements, but may further contain an element which is selected from this group and is different from these two elements. That is, the metal powder may contain three or more elements selected from the group consisting of the above-mentioned seven elements. According to this, the above-mentioned effect can be further enhanced, which slightly varies depending on the way of combination.

Further, it is preferred to set the ratio of the content of the first element to the content of the second element in consideration of the mass number of the element selected as the first element and the mass number of the element selected as the second element.

Specifically, when a value obtained by dividing the content E1 (mass %) of the first element by the mass number of the first element is represented by an index X1 and a value obtained by dividing the content E2 (mass %) of the second element by the mass number of the second element is represented by an index X2, the ratio X1/X2 of the index X1 to the index X2 is preferably 0.3 or more and 3 or less, more preferably 0.5 or more and 2 or less, further more preferably 0.75 or more and 1.3 or less. By setting the ratio X1/X2 within the above range, a difference between the timing when a carbide or the like of the first element is deposited and the timing when a carbide or the like of the second element is deposited can be optimized. According to this, pores remaining in a molded body can be eliminated as if they were swept out sequentially from the inside, and therefore, pores generated in a sintered body can be minimized. Therefore, by setting the ratio X1/X2 within the above range, a metal powder capable of producing a sintered body having a high density and excellent mechanical properties can be obtained. Further, the balance between the number of atoms of the first element and the number of atoms of the second element is optimized, and therefore, an effect brought about by the first element and an effect brought about by the second element are synergistically exhibited, and thus, a sintered body having a particularly high density can be obtained.

Here, with respect to a specific example of the combination of the first element with the second element, based on the above-mentioned range of the ratio X1/X2, the ratio E1/E2 of the content E1 (mass %) to the content E2 (mass %) is also calculated.

For example, in the case where the first element is Zr and the second element is Nb, since the mass number of Zr is 91.2 and the mass number of Nb is 92.9, E1/E2 is preferably 0.29 or more and 2.95 or less, more preferably 0.49 or more and 1.96 or less.

Further, in the case where the first element is Hf and the second element is Nb, since the mass number of Hf is 178.5 and the mass number of Nb is 92.9, E1/E2 is preferably 0.58 or more and 5.76 or less, more preferably 0.96 or more and 3.84 or less.

Further, in the case where the first element is Ti and the second element is Nb, since the mass number of Ti is 47.9 and the mass number of Nb is 92.9, E1/E2 is preferably 0.15 or more and 1.55 or less, more preferably 0.26 or more and 1.03 or less.

Further, in the case where the first element is Nb and the second element is Ta, since the mass number of Nb is 92.9 and the mass number of Ta is 180.9, E1/E2 is preferably 0.15 or more and 1.54 or less, more preferably 0.26 or more and 1.03 or less.

Further, in the case where the first element is Y and the second element is Nb, since the mass number of Y is 88.9 and the mass number of Nb is 92.9, E1/E2 is preferably 0.29 or more and 2.87 or less, more preferably 0.48 or more and 1.91 or less.

Further, in the case where the first element is V and the second element is Nb, since the mass number of V is 50.9 and the mass number of Nb is 92.9, E1/E2 is preferably 0.16 or more and 1.64 or less, more preferably 0.27 or more and 1.10 or less.

Further, in the case where the first element is Ti and the second element is Zr, since the mass number of Ti is 47.9 and the mass number of Zr is 91.2, E1/E2 is preferably 0.16 or more and 1.58 or less, more preferably 0.26 or more and 1.05 or less.

Further, in the case where the first element is Zr and the second element is Ta, since the mass number of Zr is 91.2 and the mass number of Ta is 180.9, E1/E2 is preferably 0.15 or more and 1.51 or less, more preferably 0.25 or more and 1.01 or less.

Further, in the case where the first element is Zr and the second element is V, since the mass number of Zr is 91.2 and the mass number of V is 50.9, E1/E2 is preferably 0.54 or more and 5.38 or less, more preferably 0.90 or more and 3.58 or less.

Incidentally, also in the case of a combination other than the above-mentioned combinations, E1/E2 can be calculated in the same manner as described above.

Further, the sum (E1+E2) of the content E1 of the first element and the content E2 of the second element is preferably 0.05 mass % or more and 0.6 mass % or less, more preferably 0.10 mass % or more and 0.48 mass % or less, further more preferably 0.12 mass % or more and 0.24 mass % or less. By setting the sum of the content of the first element and the content of the second element within the above range, the densification of a sintered body to be produced becomes necessary and sufficient.

Further, when the ratio of the sum of the content of the first element and the content of the second element to the content of Si is represented by (E1+E2)/Si, (E1+E2)/Si is preferably 0.1 or more and 0.7 or less, more preferably 0.15 or more and 0.6 or less, further more preferably 0.2 or more and 0.5 or less. By setting the ratio (E1+E2)/Si within the above range, a decrease in the toughness or the like when Si is added is sufficiently compensated by the addition of the first element and the second element. As a result, a metal powder capable of producing a sintered body which has excellent mechanical properties such as toughness in spite of having excellent corrosion resistance attributed to Si is obtained.

In addition, it is considered that by the addition of appropriate amounts of the first element and the second element, the carbide or the like of the first element and the carbide or the like of the second element act as "nuclei", and therefore, silicon oxide is accumulated at a crystal grain boundary in the sintered body. By the accumulation of silicon oxide at a crystal grain boundary, the concentration of oxides inside the crystal grain is decreased, and therefore, sintering is promoted. As a result, it is considered that the densification of the sintered body is further promoted.

Moreover, the deposited silicon oxide easily moves to the triple point of a crystal grain boundary during the accumulation, and therefore, the crystal growth is suppressed at this point (a flux pinning effect). As a result, the significant growth of crystal grains is suppressed, and thus, a sintered body having finer crystals is obtained. Such a sintered body has particularly high mechanical properties.

Further, the accumulated silicon oxide is easily located at the triple point of a crystal grain boundary as described above, and therefore tends to be shaped into a particle. Therefore, in the sintered body, a first region which is in the form of such a particle and has a relatively high silicon oxide content and a second region which has a relatively lower silicon oxide content than the first region are easily formed. By the existence of the first region, the concentration of oxides inside the crystal is decreased, and the significant growth of crystal grains is suppressed as described above.

Incidentally, when a qualitative and quantitative analysis is performed for the first region and the second region using an electron beam microanalyzer (EPMA), the first region contains O (oxygen) as a principal element, and the second region contains Co (cobalt) as a principal element. As described above, the first region mainly exists at a crystal grain boundary, and the second region mainly exists inside the crystal grain. Therefore, in the first region, when the sum of the contents of the two elements, O and Si, and the content of Co are compared, the sum of the contents of the two elements is higher than the content of Co. On the other hand, in the second region, the sum of the contents of the two elements, O and Si, is much smaller than the content of Co. Based on these analysis results, it is found that Si and O are accumulated in the first region. Specifically, the sum of the content of Si and the content of 0 is preferably 1.5 times or more and 10000 times or less the content of Co in the first region. Further, the content of Si in the first region is preferably 3 times or more and 10000 times or less the content of Si in the second region.

Further, at least one of the content of the first element and the content of the second element satisfies the relationship that the content in the first region is higher than the content in the second region, which may vary depending on the compositional ratio. This indicates that in the first region, the carbide or the like of the first element and the carbide or the like of the second element act as nuclei when silicon oxide is accumulated as described above. Specifically, the content of the first element in the first region is preferably 3 times or more and 10000 times or less the content of the first element in the second region. Similarly, the content of the second element in the first region is preferably 3 times or more and 10000 times or less the content of the second element in the second region.

Incidentally, the accumulation of silicon oxide as described above is considered to be one of the causes for the densification of a sintered body. Therefore, it is considered that even in a sintered body having a density increased according to the invention, silicon oxide may not be accumulated depending on the compositional ratio in some cases. That is, the first region and the second region may not be included depending on the compositional ratio.

Further, the diameter of the first region in the form of a particle varies depending on the content of Si in the entire sintered body, but is set to about 0.5 μm or more and 15 μm or less, and preferably about 1 μm or more and 10 μm or less. According to this, the densification of the sintered body can be sufficiently promoted while suppressing the decrease in the mechanical properties of the sintered body accompanying the accumulation of silicon oxide.

Incidentally, the diameter of the first region can be obtained as the average of the diameter of a circle having the same area (circle equivalent diameter) as that of the first region determined by the color density in an electron micrograph of the cross section of the sintered body. When the average is obtained, the measured values of 10 or more regions are used.

Further, when the ratio of the sum of the content of the first element and the content of the second element to the content of C is represented by (E1+E2)/C, (E1+E2)/C is preferably 1 or more and 16 or less, more preferably 2 or more and 13 or less, further more preferably 3 or more and 10 or less. By setting the ratio (E1+E2)/C within the above range, an increase in the hardness and a decrease in the toughness when C is added, and an increase in the density brought about by the addition of the first element and the second element can be achieved. As a result, a metal powder capable of producing a sintered body which has excellent mechanical properties such as tensile strength and toughness is obtained.

Other Elements

The metal powder for powder metallurgy of the invention may contain, other than the above-mentioned elements, at least one element of Fe, Ni, Mn, W, and S as needed. Incidentally, these elements may be inevitably contained in some cases.

Fe is an element which imparts high mechanical properties to a sintered body to be produced.

The content of Fe in the metal powder is not particularly limited, but is preferably 0.01 mass % or more and 25 mass % or less, more preferably 0.03 mass % or more and 5 mass % or less. By setting the content of Fe within the above range, a sintered body having a high density and excellent mechanical properties is obtained.

Ni is an element which imparts high toughness to a sintered body to be produced.

The content of Ni in the metal powder is not particularly limited, but is preferably 0.01 mass % or more and 40 mass % or less, more preferably 0.02 mass % or more and 37 mass % or less. By setting the content of Ni within the above range, a sintered body having a high density and excellent toughness is obtained.

Mn is an element which imparts corrosion resistance and high mechanical properties to a sintered body to be produced in the same manner as Si.

The content of Mn in the metal powder is not particularly limited, but is preferably 0.05 mass % or more and 1.5 mass % or less, more preferably 0.1 mass % or more and 1 mass % or less. By setting the content of Mn within the above range, a sintered body having a high density and excellent mechanical properties is obtained. Further, Mn can increase the mechanical strength while suppressing the decrease in elongation. Further, Mn can suppress the increase in brittleness at a high temperature (when glowing).

Incidentally, if the content of Mn is less than the above lower limit, the corrosion resistance or mechanical properties of a sintered body to be produced may not be sufficiently enhanced depending on the overall composition. On the other hand, if the content of Mn exceeds the above upper limit, the corrosion resistance or mechanical properties may be deteriorated instead.

W is an element which enhances the heat resistance of a sintered body to be produced.

The content of W in the metal powder is not particularly limited, but is preferably 1 mass % or more and 20 mass % or less, more preferably 2 mass % or more and 16 mass % or less. By setting the content of W within the above range, the heat resistance of a sintered body to be produced can be further enhanced without causing a large decrease in the density of the sintered body.

S is an element which enhances the machinability of a sintered body to be produced.

The content of S in the metal powder is not particularly limited, but is preferably 0.5 mass % or less, more preferably 0.01 mass % or more and 0.3 mass % or less. By setting the content of S within the above range, the machinability of a sintered body to be produced can be further enhanced without causing a large decrease in the density of the sintered body.

To the metal powder for powder metallurgy of the invention, B, Se, Te, Pd, or the like may be added other than the above-mentioned elements. At this time, the contents of these elements are not particularly limited, but the content of each of these elements is preferably less than 0.1 mass %, and also the total content of these elements is preferably less than 0.2 mass %. Incidentally, these elements may be inevitably contained in some cases.

Further, the metal powder for powder metallurgy of the invention may contain impurities. Examples of the impurities include all elements other than the above-mentioned elements, and specific examples thereof include Li, Be, Na, Mg, P, K, Ca, Sc, Zn, Ga, Ge, Ag, In, Sn, Sb, Os, Ir, Pt, Au, and Bi. The incorporation amounts of these impurities are preferably set such that the content of each of the impurity elements is less than the content of each of Co, Cr, Si, the first element, and the second element. Further, the incorporation amounts of these impurities are preferably set such that the content of each of the impurity elements is less than 0.03 mass %, more preferably less than 0.02 mass %. Further, the total content of these impurity elements is set to preferably less than 0.3 mass %, more preferably less than 0.2 mass %. Incidentally, these elements do not inhibit the effect as described above as long as the contents thereof are within the above range, and therefore may be intentionally added to the metal powder.

Meanwhile, O (oxygen) may also be intentionally added to or inevitably mixed in the metal powder, however, the amount thereof is preferably about 0.8 mass % or less, more preferably about 0.5 mass % or less. By controlling the amount of oxygen in the metal powder within the above range, the sinterability is enhanced, and thus, a sintered body having a high density and excellent mechanical properties is obtained. Incidentally, the lower limit thereof is not particularly set, but is preferably 0.03 mass % or more from the viewpoint of ease of mass production or the like.

Co is a component (principal component) whose content is the highest in the alloy constituting the metal powder for powder metallurgy of the invention and has a great influence on the properties of the sintered body. The content of Co is not particularly limited, but is preferably 50 mass % or more, more preferably 55 mass % or more and 67.5 mass % or less.

Further, the compositional ratio of the metal powder for powder metallurgy can be determined by, for example, Iron and steel—Atomic absorption spectrometric method specified in JIS G 1257 (2000), Iron and steel—ICP atomic emission spectrometric method specified in JIS G 1258 (2007), Iron and steel—Method for spark discharge atomic emission spectrometric analysis specified in JIS G 1253 (2002), Iron and steel—Method for X-ray fluorescence spectrometric analysis specified in JIS G 1256 (1997), gravimetric, titrimetric, and absorption spectrometric methods specified in JIS G 1211 to G 1237, or the like. Specifically, for example, an optical emission spectrometer for solids (spark optical emission spectrometer, model: SPECTROLAB, type: LAVMB08A) manufactured by SPECTRO Analytical Instruments GmbH or an ICP device (model: CIROS-120) manufactured by Rigaku Corporation can be used.

Incidentally, JIS G 1211 to G 1237 are as follows.

JIS G 1211 (2011): Iron and steel—Methods for determination of carbon content

JIS G 1212 (1997): Iron and steel—Methods for determination of silicon content

JIS G 1213 (2001): Iron and steel—Methods for determination of manganese content JIS G 1214 (1998): Iron and steel—Methods for determination of phosphorus content JIS G 1215 (2010): Iron and steel—Methods for determination of sulfur content JIS G 1216 (1997): Iron and steel—Methods for determination of nickel content JIS G 1217 (2005): Iron and steel—Methods for determination of chromium content JIS G 1218 (1999): Iron and steel—Methods for determination of molybdenum content JIS G 1219 (1997): Iron and steel—Methods for determination of copper content JIS G 1220 (1994): Iron and steel—Methods for determination of tungsten content JIS G 1221 (1998): Iron and steel—Methods for determination of vanadium content JIS G 1222 (1999): Iron and steel—Methods for determination of cobalt content JIS G 1223 (1997): Iron and steel—Methods for determination of titanium content JIS G 1224 (2001): Iron and steel—Methods for determination of aluminum content JIS G 1225 (2006): Iron and steel—Methods for determination of arsenic content JIS G 1226 (1994): Iron and steel—Methods for determination of tin content JIS G 1227 (1999): Iron and steel—Methods for determination of boron content JIS G 1228 (2006): Iron and steel—Methods for determination of nitrogen content JIS G 1229 (1994): Steel—Methods for determination of lead content JIS G 1232 (1980): Methods for determination of zirconium in steel JIS G 1233 (1994): Steel—Method for determination of selenium content JIS G 1234 (1981): Methods for determination of tellurium in steel JIS G 1235 (1981): Methods for determination of antimony in iron and steel JIS G 1236 (1992): Method for determination of tantalum in steel JIS G 1237 (1997): Iron and steel—Methods for determination of niobium content Further, when C (carbon) and S (sulfur) are determined, particularly, an infrared absorption method after combustion in a current of oxygen (after combustion in a high-frequency induction heating furnace) specified in JIS G 1211 (2011) is also used. Specifically, a carbon-sulfur analyzer, CS-200 manufactured by LECO Corporation can be used.

Further, when N (nitrogen) and O (oxygen) are determined, particularly, a method for determination of nitrogen content in iron and steel specified in JIS G 1228 (2006) and a method for determination of oxygen content in metallic materials specified in JIS Z 2613 (2006) are also used. Specifically, an oxygen-nitrogen analyzer, TC-300/EF-300 manufactured by LECO Corporation can be used.

Further, the average particle diameter of the metal powder for powder metallurgy of the invention is preferably 0.5 μm or more and 30 μm or less, more preferably 1 μm or more and 20 μm or less, further more preferably 2 μm or more and 10 μm or less. By using the metal powder for powder metallurgy having such a particle diameter, pores remaining in a sintered body are extremely reduced, and therefore, a sintered body having a particularly high density and particularly excellent mechanical properties can be produced.

Incidentally, the average particle diameter can be obtained as a particle diameter when the cumulative amount from the small diameter side reaches 50% in a cumulative particle size distribution on a mass basis obtained by laser diffractometry.

Further, if the average particle diameter of the metal powder for powder metallurgy is less than the above lower limit, the moldability is deteriorated when molding the shape which is difficult to mold, and therefore, the sintered density may be decreased, and if the average particle diameter of the metal powder exceeds the above upper limit, spaces between the particles become larger during molding, and therefore, the sintered density may be decreased also in this case.

Further, the particle size distribution of the metal powder for powder metallurgy is preferably as narrow as possible. Specifically, when the average particle diameter of the metal powder for powder metallurgy is within the above range, the maximum particle diameter of the metal powder is preferably 200 μm or less, more preferably 150 μm or less. By controlling the maximum particle diameter of the metal powder for powder metallurgy within the above range, the particle size distribution of the metal powder for powder metallurgy can be narrowed, and thus, the density of the sintered body can be further increased.

Incidentally, the above-mentioned "maximum particle diameter" refers to a particle diameter when the cumulative amount from the small diameter side reaches 99.9% in a cumulative particle size distribution on a mass basis obtained by laser diffractometry.

Further, when the minor axis of each particle of the metal powder for powder metallurgy is represented by S [μm] and the major axis thereof is represented by L [μm], the average of the aspect ratio defined by S/L is preferably about 0.4 or more and 1 or less, more preferably about 0.7 or more and 1 or less. The metal powder for powder metallurgy having an aspect ratio within such a range has a shape relatively close to a spherical shape, and therefore, the packing factor when the metal powder is molded is increased. As a result, the density of the sintered body can be further increased.

Incidentally, the above-mentioned "major axis" is the maximum possible length in the projected image of the particle, and the "minor axis" is the maximum possible length in the direction perpendicular to the major axis. Incidentally, the average of the aspect ratio can be obtained as the average of the measured aspect ratios of 100 or more particles.

Further, the tap density of the metal powder for powder metallurgy of the invention is preferably 3.5 g/cm$^3$ or more, more preferably 4 g/cm$^3$ or more. According to the metal powder for powder metallurgy having such a high tap density, when a molded body is obtained, the interparticle packing efficiency is particularly increased. Therefore, a particularly dense sintered body can be obtained in the end.

Further, the specific surface area of the metal powder for powder metallurgy of the invention is not particularly limited, but is preferably 0.1 m$^2$/g or more, more preferably 0.2 m$^2$/g or more. According to the metal powder for powder metallurgy having such a large specific surface area, a surface activity (surface energy) is increased so that it is possible to easily sinter the metal powder even if less energy is applied. Therefore, when a molded body is sintered, a difference in sintering rate hardly occurs between the inner side and the outer side of the molded body, and thus, the decrease in the sintered density due to pores remaining inside the molded body can be suppressed.

Further, the metal powder for powder metallurgy of the invention preferably contains, for example, a chemical component of a cobalt-chromium alloy specified in JIS T 6115 (2013).

Incidentally, the above-mentioned "chemical component" refers to a chemical component specified in JIS T 6115 (2013), and specifically refers to, for example, a combination of elements contained according to the contents (unit: mass %) specified in clause 4.3 of JIS T 6115 (2013).

[Method for Producing Sintered Body]

Next, a method for producing a sintered body using such a metal powder for powder metallurgy of the invention will be described.

The method for producing a sintered body includes [A] a composition preparation step in which a composition for producing a sintered body is prepared, [B] a molding step in which a molded body is produced, [C] a degreasing step in which a degreasing treatment is performed, and [D] a firing step in which firing is performed. Hereinafter, the respective steps will be described sequentially.

[A] Composition Preparation Step

First, the metal powder for powder metallurgy of the invention and a binder are prepared, and these materials are kneaded using a kneader, whereby a kneaded material is obtained.

In this kneaded material (an embodiment of the compound of the invention), the metal powder for powder metallurgy is uniformly dispersed.

The metal powder for powder metallurgy of the invention is produced by, for example, any of a variety of powdering methods such as an atomization method (such as a water atomization method, a gas atomization method, or a spinning water atomization method), a reducing method, a carbonyl method, and a pulverization method.

Among these, the metal powder for powder metallurgy of the invention is preferably a metal powder produced by an atomization method, more preferably a metal powder produced by a water atomization method or a spinning water atomization method. The atomization method is a method in which a molten metal (metal melt) is caused to collide with a fluid (liquid or gas) sprayed at a high speed to atomize the metal melt into a fine powder and also to cool the fine powder, whereby a metal powder is produced. By producing the metal powder for powder metallurgy through such an atomization method, an extremely fine powder can be efficiently produced. Further, the shape of the particle of the obtained powder is closer to a spherical shape by the action of surface tension. Due to this, a metal powder having a high packing factor when molding is obtained. That is, a powder capable of producing a sintered body having a high density can be obtained.

Incidentally, in the case where a water atomization method is used as the atomization method, the pressure of water (hereinafter referred to as "atomization water") to be sprayed to the molten metal is not particularly limited, but is set to preferably about 75 MPa or more and 120 MPa or less (750 kgf/cm$^2$ or more and 1200 kgf/cm$^2$ or less), more preferably about 90 MPa or more and 120 MPa or less (900 kgf/cm$^2$ or more and 1200 kgf/cm$^2$ or less).

The temperature of the atomization water is also not particularly limited, but is preferably set to about 1° C. or higher and 20° C. or lower.

Further, the atomization water is often sprayed in a cone shape such that it has a vertex on the falling path of the metal melt and the outer diameter gradually decreases downward. In this case, the vertex angle of the cone formed by the atomization water is preferably about 10° or more and 40° or less, more preferably about 15° or more and 35° or less. According to this, a metal powder for powder metallurgy having a composition as described above can be reliably produced.

Further, by using a water atomization method (particularly, a spinning water atomization method), the metal melt can be cooled particularly quickly. Due to this, a powder having high quality can be obtained in a wide alloy composition range.

Further, the cooling rate when cooling the metal melt in the atomization method is preferably $1\times10^{4}$° C./s or more, more preferably $1\times10^{5}$° C./s or more. By the quick cooling in this manner, a homogeneous metal powder for powder metallurgy can be obtained. As a result, a sintered body having high quality can be obtained.

Incidentally, the thus obtained metal powder for powder metallurgy may be classified as needed. Examples of the classification method include dry classification such as sieving classification, inertial classification, and centrifugal classification, and wet classification such as sedimentation classification.

On the other hand, examples of the binder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyimide, polyethylene terephthalate, and polybutylene terephthalate, various resins such as polyether, polyvinyl alcohol, polyvinylpyrrolidone, and copolymers thereof, and various organic binders such as various waxes, paraffins, higher fatty acids (such as stearic acid), higher alcohols, higher fatty acid esters, and higher fatty acid amides. These can be used alone or by mixing two or more types thereof.

Further, the content of the binder is preferably about 2 mass % or more and 20 mass % or less, more preferably about 5 mass % or more and 10 mass % or less with respect to the total amount of the kneaded material. By setting the content of the binder within the above range, a molded body can be formed with good moldability, and also the density is increased, whereby the stability of the shape of the molded body and the like can be particularly enhanced. Further, according to this, a difference in size between the molded body and the degreased body, that is, a so-called shrinkage ratio is optimized, whereby a decrease in the dimensional accuracy of the finally obtained sintered body can be prevented. That is, a sintered body having a high density and high dimensional accuracy can be obtained.

Further, in the kneaded material, a plasticizer may be added as needed. Examples of the plasticizer include phthalate esters (such as DOP, DEP, and DBP), adipate esters, trimellitate esters, and sebacate esters. These can be used alone or by mixing two or more types thereof.

Further, in the kneaded material, other than the metal powder for powder metallurgy, the binder, and the plasticizer, for example, any of a variety of additives such as a lubricant, an antioxidant, a degreasing accelerator, and a surfactant can be added as needed.

Incidentally, the kneading conditions vary depending on the respective conditions such as the metal composition or the particle diameter of the metal powder for powder metallurgy to be used, the composition of the binder, and the blending amount thereof. However, for example, the kneading temperature can be set to about 50° C. or higher and 200° C. or lower, and the kneading time can be set to about 15 minutes or more and 210 minutes or less.

Further, the kneaded material is formed into a pellet (small particle) as needed. The particle diameter of the pellet is set to, for example, about 1 mm or more and 15 mm or less.

Incidentally, depending on the molding method described below, in place of the kneaded material, a granulated powder may be produced. The kneaded material, the granulated powder, and the like are examples of the composition to be subjected to the molding step described below.

The embodiment of the granulated powder of the invention is a granulated powder obtained by binding a plurality of metal particles to one another with a binder by subjecting the metal powder for powder metallurgy of the invention to a granulation treatment.

Examples of the binder to be used for producing the granulated powder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyimide, polyethylene terephthalate, and polybutylene terephthalate, various resins such as polyether, polyvinyl alcohol, polyvinylpyrrolidone, and copolymers thereof, and various organic binders such as various waxes, paraffins, higher fatty acids (such as stearic acid), higher alcohols, higher fatty acid esters, and higher fatty acid amides. These can be used alone or by mixing two or more types thereof.

Among these, as the binder, a binder containing a polyvinyl alcohol or polyvinylpyrrolidone is preferred. These binder components have a high binding ability, and therefore can efficiently form the granulated powder even in a relatively small amount. Further, the thermal decomposability thereof is also high, and therefore, the binder can be reliably decomposed and removed in a short time during degreasing and firing.

Further, the content of the binder is preferably about 0.2 mass % or more and 10 mass % or less, more preferably about 0.3 mass % or more and 5 mass % or less, further more preferably about 0.3 mass % or more and 2 mass % or less with respect to the total amount of the granulated powder. By setting the content of the binder within the above range, the granulated powder can be efficiently formed while preventing significantly large particles from being formed or the metal particles which are not granulated from remaining in a large amount. Further, since the moldability is improved, the stability of the shape of the molded body and the like can be particularly enhanced. Further, by setting the content of the binder within the above range, a difference in size between the molded body and the degreased body, that is, a so-called shrinkage ratio is optimized, whereby a decrease in the dimensional accuracy of the finally obtained sintered body can be prevented.

Further, in the granulated powder, any of a variety of additives such as a plasticizer, a lubricant, an antioxidant, a degreasing accelerator, and a surfactant may be added as needed.

On the other hand, examples of the granulation treatment include a spray drying method, a tumbling granulation method, a fluidized bed granulation method, and a tumbling fluidized bed granulation method.

Incidentally, in the granulation treatment, a solvent which dissolves the binder is used as needed. Examples of the solvent include inorganic solvents such as water and carbon tetrachloride, and organic solvents such as ketone-based solvents, alcohol-based solvents, ether-based solvents, cellosolve-based solvents, aliphatic hydrocarbon-based solvents, aromatic hydrocarbon-based solvents, aromatic heterocyclic compound-based solvents, amide-based solvents, halogen compound-based solvents, ester-based solvents, amine-based solvents, nitrile-based solvents, nitro-based solvents, and aldehyde-based solvents, and one type or a mixture of two or more types selected from these solvents is used.

The average particle diameter of the granulated powder is not particularly limited, but is preferably about 10 μm or more and 200 μm or less, more preferably about 20 μm or more and 100 μm or less, further more preferably about 25 μm or more and 60 μm or less. The granulated powder having such a particle diameter has favorable fluidity, and can more faithfully reflect the shape of a molding die.

Incidentally, the average particle diameter can be obtained as a particle diameter when the cumulative amount from the small diameter side reaches 50% in a cumulative particle size distribution on a mass basis obtained by laser diffractometry.

[B] Molding Step

Subsequently, the kneaded material or the granulated powder is molded, whereby a molded body having the same shape as that of a target sintered body is produced.

The method for producing a molded body (molding method) is not particularly limited, and for example, any of a variety of molding methods such as a powder compaction molding (compression molding) method, a metal injection molding (MIM) method, and an extrusion molding method can be used.

The molding conditions in the case of a powder compaction molding method among these methods are preferably such that the molding pressure is about 200 MPa or more and 1000 MPa or less (2 t/cm$^2$ or more and 10 t/cm$^2$ or less), which vary depending on the respective conditions such as the composition and the particle diameter of the metal powder for powder metallurgy to be used, the composition of the binder, and the blending amount thereof.

Further, the molding conditions in the case of a metal injection molding method are preferably such that the material temperature is about 80° C. or higher and 210° C. or lower, and the injection pressure is about 50 MPa or more and 500 MPa or less (0.5 t/cm$^2$ or more and 5 t/cm$^2$ or less), which vary depending on the respective conditions.

Further, the molding conditions in the case of an extrusion molding method are preferably such that the material temperature is about 80° C. or higher and 210° C. or lower, and the extrusion pressure is about 50 MPa or more and 500 MPa or less (0.5 t/cm$^2$ or more and 5 t/cm$^2$ or less), which vary depending on the respective conditions.

The thus obtained molded body is in a state where the binder is uniformly distributed in spaces between the particles of the metal powder.

Incidentally, the shape and size of the molded body to be produced are determined in anticipation of shrinkage of the molded body in the subsequent degreasing step and firing step.

[C] Degreasing Step

Subsequently, the thus obtained molded body is subjected to a degreasing treatment (binder removal treatment), whereby a degreased body is obtained.

Specifically, the binder is decomposed by heating the molded body, whereby the binder is removed from the molded body. In this manner, the degreasing treatment is performed.

Examples of the degreasing treatment include a method of heating the molded body and a method of exposing the molded body to a gas capable of decomposing the binder.

In the case of using a method of heating the molded body, the conditions for heating the molded body are preferably such that the temperature is about 100° C. or higher and 750° C. or lower and the time is about 0.1 hours or more and 20 hours or less, and more preferably such that the temperature is about 150° C. or higher and 600° C. or lower and the time is about 0.5 hours or more and 15 hours or less, which slightly vary depending on the composition and the blending amount of the binder. According to this, the degreasing of the molded body can be necessarily and sufficiently performed without sintering the molded body. As a result, it is possible to reliably prevent the binder component from remaining inside the degreased body in a large amount.

Further, the atmosphere when the molded body is heated is not particularly limited, and an atmosphere of a reducing gas such as hydrogen, an atmosphere of an inert gas such as nitrogen or argon, an atmosphere of an oxidative gas such as air, a reduced pressure atmosphere obtained by reducing the pressure of such an atmosphere, or the like can be used.

On the other hand, examples of the gas capable of decomposing the binder include ozone gas.

Incidentally, by dividing this degreasing step into a plurality of steps in which the degreasing conditions are different, and performing the plurality of steps, the binder in the molded body can be more rapidly decomposed and removed so that the binder does not remain in the molded body.

Further, according to need, the degreased body may be subjected to a machining process such as grinding, polishing, or cutting. The degreased body has a relatively low hardness and relatively high plasticity, and therefore, the machining process can be easily performed while preventing the degreased body from losing its shape. According to such a machining process, a sintered body having high dimensional accuracy can be easily obtained in the end.

[D] Firing Step

The degreased body obtained in the above step [C] is fired in a firing furnace, whereby a sintered body is obtained.

By this sintering, in the metal powder for powder metallurgy, diffusion occurs at the boundary surface between the particles, resulting in sintering. At this time, by the mechanism as described above, the degreased body is rapidly sintered. As a result, a sintered body which is dense and has a high density on the whole is obtained.

The firing temperature varies depending on the composition, the particle diameter, and the like of the metal powder for powder metallurgy used in the production of the molded body and the degreased body, but is set to, for example, about 980° C. or higher and 1450° C. or lower, and preferably set to about 1050° C. or higher and 1350° C. or lower.

Further, the firing time is set to 0.2 hours or more and 7 hours or less, but is preferably set to about 1 hour or more and 6 hours or less.

In the firing step, the firing temperature or the below-described firing atmosphere may be changed in the middle of the step.

By setting the firing conditions within such a range, it is possible to sufficiently sinter the entire degreased body while preventing the sintering from proceeding excessively to cause oversintering and increase the size of the crystal structure. As a result, a sintered body having a high density and particularly excellent mechanical properties can be obtained.

Further, since the firing temperature is a relatively low temperature, it is easy to control the heating temperature in the firing furnace to be constant, and therefore, also the temperature of the degreased body is likely to be constant. As a result, a more homogeneous sintered body can be produced.

Further, since the firing temperature as described above is a temperature which can be sufficiently realized using a common firing furnace, and therefore, an inexpensive firing furnace can be used, and also the running cost can be kept low. In other words, in the case where the temperature exceeds the above-mentioned firing temperature, it is necessary to employ an expensive firing furnace using a special heat resistant material, and also the running cost may be increased.

Further, the atmosphere when performing firing is not particularly limited, however, in consideration of prevention of significant oxidation of the metal powder, an atmosphere of a reducing gas such as hydrogen, an atmosphere of an inert gas such as argon, a reduced pressure atmosphere obtained by reducing the pressure of such an atmosphere, or the like is preferably used.

The thus obtained sintered body has a high density and excellent mechanical properties. That is, a sintered body produced by molding a composition containing the metal powder for powder metallurgy of the invention and a binder, followed by degreasing and sintering has a higher relative density than a sintered body obtained by sintering a metal powder in the related art. Therefore, according to the invention, a sintered body having a high density which could not be obtained unless an additional treatment such as an HIP treatment is performed can be realized without performing an additional treatment.

Specifically, according to the invention, for example, the relative density can be expected to be increased by 2% or more as compared with the related art, which slightly varies depending on the composition of the metal powder for powder metallurgy.

As a result, the relative density of the obtained sintered body can be expected to be, for example, 97% or more (preferably 98% or more, more preferably 98.5% or more). The sintered body having a relative density within such a range has excellent mechanical properties comparable to those of ingot materials although it has a shape closest to the desired shape by using a powder metallurgy technique, and therefore, the sintered body can be applied to a variety of machine components, structural components, and the like with virtually no post-processing.

Further, the tensile strength and the 0.2% proof stress of a sintered body produced by molding a composition containing the metal powder for powder metallurgy of the invention and a binder, followed by degreasing and sintering are higher than those of a sintered body obtained by performing sintering in the same manner using a metal powder in the related art. This is considered to be because by optimizing the alloy composition, the sinterability of the metal powder is enhanced, and thus, the mechanical properties of a sintered body to be produced using the metal powder are enhanced.

Further, the sintered body produced as described above has a high surface hardness. Specifically, as one example, the Vickers hardness of the surface of the sintered body is expected to be 300 or more and 780 or less, which slightly varies depending on the composition of the metal powder for powder metallurgy, and further is expected to be preferably 340 or more and 600 or less. The sintered body having such a hardness has both wear resistance and impact resistance, and therefore has particularly high durability.

Further, the sintered body has a sufficiently high density and excellent mechanical properties even without performing an additional treatment, however, in order to further increase the density and enhance the mechanical properties, a variety of additional treatments may be performed.

As the additional treatment, for example, an additional treatment of increasing the density such as the HIP treatment described above may be performed, and also a variety of quenching treatments, a variety of sub-zero treatments, a variety of tempering treatments, a variety of annealing treatments, and the like may be performed. These additional treatments may be performed alone or two or more treatments thereof may be performed in combination.

Further, in the firing step and a variety of additional treatments described above, a light element in the metal powder (in the sintered body) is volatilized, and the composition of the finally obtained sintered body slightly changes from the composition of the metal powder in some cases.

For example, the content of C in the final sintered body may change within the range of 5% or more and 100% or less (preferably within the range of 30% or more and 100% or less) of the content of C in the metal powder for powder metallurgy, which varies depending on the conditions for the step or the conditions for the treatment.

Further, also the content of O in the final sintered body may change within the range of 1% or more and 50% or less (preferably within the range of 3% or more and 50% or less) of the content of O in the metal powder for powder metallurgy, which varies depending on the conditions for the step or the conditions for the treatment.

On the other hand, as described above, the produced sintered body may be subjected to an HIP treatment as part of the additional treatments to be performed as needed, however, even if the HIP treatment is performed, a sufficient effect is not exhibited in many cases. In the HIP treatment, the density of the sintered body can be further increased, however, in the first place, the density of the sintered body obtained according to the invention has already been sufficiently increased at the end of the firing step. Therefore, even if the HIP treatment is further performed, further densification hardly proceeds.

In addition, in the HIP treatment, it is necessary to apply pressure to a material to be treated through a pressure medium, and therefore, the material to be treated may be contaminated, the composition or the physical properties of the material to be treated may unintentionally change accompanying the contamination, or the color of the material to be treated may change accompanying the contamination. Further, by the application of pressure, residual stress is generated or increased in the material to be treated, and a problem such as a change in the shape or a decrease in the dimensional accuracy may occur as the residual stress is released over time.

On the other hand, according to the invention, a sintered body having a sufficiently high density can be produced without performing such an HIP treatment, and therefore, a sintered body having an increased density and also an increased strength can be obtained in the same manner as in the case of performing an HIP treatment. Such a sintered body is less contaminated and discolored, and also an unintended change in the composition or physical properties, or the like occurs less, and also a problem such as a change in the shape or a decrease in the dimensional accuracy occurs less. Therefore, according to the invention, a sintered body having high mechanical strength and dimensional accuracy, and excellent durability can be efficiently produced.

Further, the sintered body produced according to the invention requires almost no additional treatments for enhancing the mechanical properties, and therefore, the composition and the crystal structure tend to become uniform in the entire sintered body. Due to this, the sintered body has high structural isotropy and therefore has excellent durability against a load from every direction regardless of its shape.

Incidentally, it is confirmed that in the thus produced sintered body, the porosity near the surface thereof is often relatively lower than the porosity inside the sintered body. The reason for this is not clear, however, one of the reasons is due to the fact that by adding the first element and the second element, a sintering reaction is more likely to proceed near the surface than inside the molded body.

Specifically, when the porosity near the surface of the sintered body is represented by A1 and the porosity inside the sintered body is represented by A2, A2-A1 is preferably 0.1% or more and 3% or less, more preferably 0.2% or more and 2% or less. The sintered body showing the value of A2-A1 within the above range not only has necessary and sufficient mechanical strength, but also can easily flatten the surface. That is, by polishing the surface of such a sintered body, a surface having high specularity can be obtained.

Such a sintered body having high specularity not only has high mechanical strength, but also has excellent aesthetic properties. Therefore, such a sintered body is favorably used also for application requiring excellent aesthetic appearance.

Incidentally, the porosity A1 near the surface of the sintered body refers to a porosity in a 25-μm radius region centered on the position at a depth of 50 μm from the surface of the cross section of the sintered body. Further, the porosity A2 inside the sintered body refers to a porosity in a 25-μm radius region centered on the position at a depth of 300 μm from the surface of the cross section of the sintered body. These porosities are values obtained by observing the cross section of the sintered body with a scanning electron microscope and dividing the area of pores present in the region by the area of the region.

[Ornament]

The sintered body of the invention can be applied to, for example, an ornament. An embodiment of the ornament of the invention is configured such that at least a portion thereof is constituted by the above-mentioned sintered body (an embodiment of the sintered body of the invention).

An embodiment of the ornament of the invention can be applied to external components for timepieces such as watch cases (case bodies, case backs, one-piece cases in which a case body and a case back are integrated, etc.), watch bands (including band clasps, band-bangle attachment mechanisms, etc.), bezels (for example, rotatable bezels, etc.), crowns (for example, screw-lock crowns, etc.), buttons, glass frames, dial rings, etching plates, and packings, personal ornaments such as glasses (for example, frames for glasses), tie clips, cuff buttons, rings, necklaces, bracelets, anklets, brooches, pendants, earrings, and pierced earrings, eating utensils such as spoons, forks, chopsticks, knives, butter knives, and corkscrews, lighters or lighter cases, sports goods such as golf clubs, nameplates, panels, prize cups, and other housings of various types of apparatus components (for example, housings of cellular phones, smartphones, tablet terminals, mobile computers, music players, cameras, shavers, etc.), various types of containers, and the like. Any of these articles is an article which can be used in contact with the human skin, and is required to have excellent aesthetic appearance and also is required to have resistance to body fluids such as sweat and saliva, food, detergents, other chemicals, and the like. Therefore, by applying the ornament of the invention to these articles, an ornament having excellent corrosion resistance attributed to the increase in the density, that is, an ornament capable of maintaining excellent aesthetic appearance over a long period of time, and also is hardly deteriorated or the like by body fluids and the like can be realized. Further, these ornaments have excellent mechanical properties attributed to the sintered body having a high density, and therefore, particularly have high corrosion resistance and high hardness, and are less susceptible to scratching, and thus can maintain excellent aesthetic appearance over a long period of time also from such a viewpoint.

Hereinafter, an embodiment of the ornament of the invention will be described by showing an external component for a timepiece, a personal ornament, and an eating utensil as examples.

(External Component for Timepiece)

First, an external component for a timepiece to which an embodiment of the ornament of the invention is applied will be described.

Figure 2:
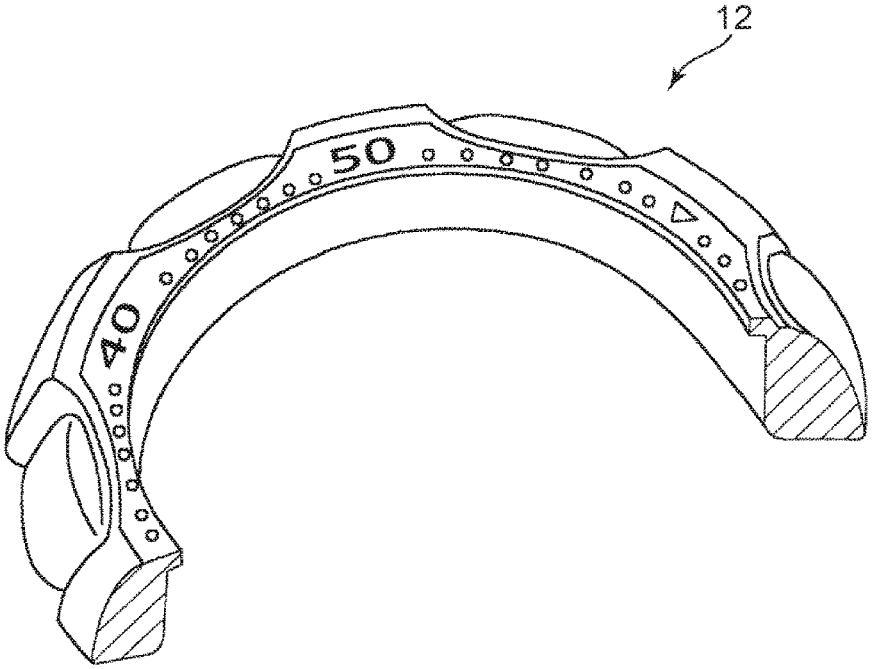
FIG. 2 is a partial cross-sectional perspective view showing a bezel to which an embodiment of an ornament of the invention is applied.

FIG. 1 is a perspective view showing a watch case to which an embodiment of the ornament of the invention is applied, and FIG. 2 is a partial cross-sectional perspective view showing a bezel to which an embodiment of the ornament of the invention is applied.

A watch case 11 shown in FIG. 1 includes a case main body 112 and a band attachment section 114 for attaching a watch band provided protruding from the case main body 112. Such a watch case 11 can construct a container along with a glass plate (not shown) and a case back (not shown). In this container, a movement (not shown), a dial plate (not shown), etc. are housed. Therefore, this container protects the movement and the like from the external environment and also has a large influence on the aesthetic appearance of the watch.

A bezel 12 shown in FIG. 2 has an annular shape, and is attached to a watch case, and is rotatable with respect to the watch case as needed. When the bezel 12 is attached to a watch case, the bezel 12 is located outside the watch case, and therefore has an influence on the aesthetic appearance of the watch.

Further, such a watch case 11 and a bezel 12 are used in a state of being in contact with the human wrist or the like, and therefore come in contact with sweat over a long period of time. Due to this, in the case where the corrosion resistance of the watch case 11 and the bezel 12 is low, rust is caused by sweat, and deterioration of the aesthetic appearance, a decrease in the mechanical properties, or the like may be caused. Therefore, by using the above-mentioned sintered body as a constituent material of such an external component for a timepiece, an external component for a timepiece having excellent corrosion resistance is obtained. Further, the watch case 11 and the bezel 12 have excellent mechanical properties attributed to the sintered body having a high density, and therefore, particularly have high corrosion resistance and high hardness, and are less susceptible to scratching, and thus can maintain excellent aesthetic appearance over a long period of time also from such a viewpoint.

(Personal Ornament)

Next, a personal ornament to which an embodiment of the ornament of the invention is applied will be described.

Figure 3:
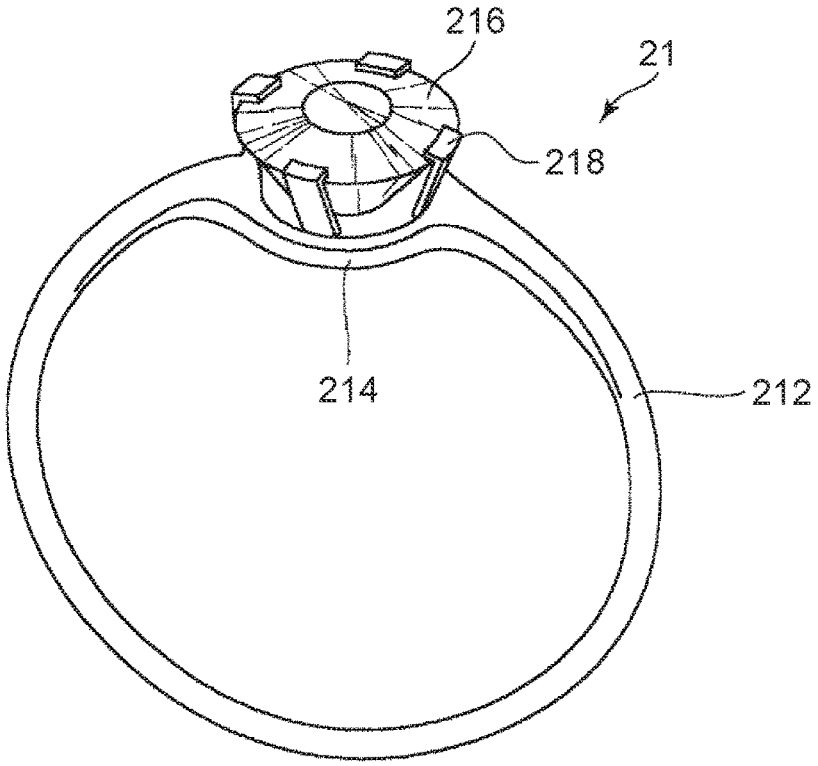
FIG. 3 is a perspective view showing a ring to which an embodiment of an ornament of the invention is applied.

FIG. 3 is a perspective view showing a ring to which an embodiment of the ornament of the invention is applied.

A ring 21 shown in FIG. 3 includes a ring main body 212, a bezel 214 provided for the ring main body 212, and a precious stone 216 attached to the bezel 214. In this ring 21, the ring main body 212 and the bezel 214 are integrally formed from the above-mentioned sintered body. Further, the precious stone 216 is fixed by claws 218 included in the bezel 214.

The ring main body 212 and the bezel 214 are used in a state of being in contact with the human finger or the like, and therefore also come in contact with sweat over a long period of time. Due to this, in the case where the corrosion resistance of the ring main body 212 and the bezel 214 is low, rust is caused by sweat, and deterioration of the aesthetic appearance or a decrease in the mechanical properties may be caused. Therefore, by using the above-mentioned sintered body as a constituent material of the ring main body 212 and the bezel 214, a personal ornament having excellent corrosion resistance is obtained. Further, such a ring main body 212 and a bezel 214 have excellent mechanical properties attributed to the sintered body having a high density, and therefore, particularly have high corrosion resistance and high hardness, and are less susceptible to scratching, and thus can maintain excellent aesthetic appearance over a long period of time also from such a viewpoint.

(Eating Utensil)

Next, an eating utensil to which an embodiment of the ornament of the invention is applied will be described.

Figure 4:
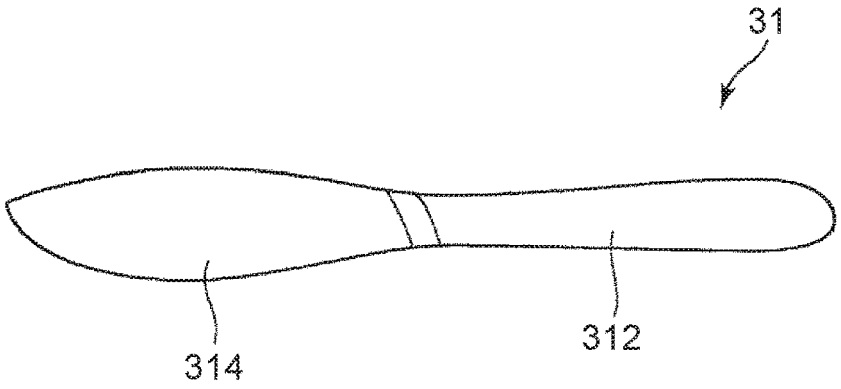
FIG. 4 is a plan view showing a knife to which an embodiment of an ornament of the invention is applied.

FIG. 4 is a plan view showing a knife to which an embodiment of the ornament of the invention is applied.

A knife 31 shown in FIG. 4 includes a handle section 312 and a blade section 314 extending from the handle section 312. The handle section 312 and the blade section 314 are integrally formed from the above-mentioned sintered body. Further, the handle section 312 is used in a state of being in contact with the human hand or the like, and therefore also comes in contact with sweat over a long period of time. Further, the blade section 314 is used in a state of being in contact with food or the like, and therefore comes in contact with an acid or the like. Due to this, in the case where the corrosion resistance of the handle section 312 and the blade section 314 is low, rust is caused by sweat or an acid, and deterioration of the aesthetic appearance or a decrease in the mechanical properties may be caused. Therefore, by using the above-mentioned sintered body as a constituent material of the handle section 312 and the blade section 314, an eating utensil having excellent corrosion resistance is obtained. Further, such a knife 31 has excellent mechanical properties attributed to the sintered body having a high density, and therefore, particularly has high corrosion resistance and high hardness, and is less susceptible to scratching, and thus can maintain excellent aesthetic appearance over a long period of time also from such a viewpoint.

Incidentally, the shapes of the external component for a timepiece, the personal ornament, and the eating utensil as described above are merely examples, and the embodiment of the ornament of the invention is not limited to the shapes shown in the drawings. For example, the external component for a timepiece is not limited to the external component for a watch, and can also be applied to an external component for a pocket watch.

[Supercharger Component]

The sintered body of the invention can be applied to, for example, a supercharger component. The supercharger component described below is configured such that at least a portion thereof is constituted by the above-mentioned sintered body (an embodiment of the sintered body of the invention).

Examples of such a supercharger component include a nozzle vane for a turbocharger, a turbine wheel for a turbocharger, a waste gate valve, and a turbine housing. Any of these articles is exposed to a high temperature over a long period of time, and also slides between other components, and therefore is required to have wear resistance. As described above, the sintered body of the invention has a high density, and therefore has excellent mechanical properties and has high weather resistance and high hardness. Due to this, a supercharger component having excellent durability over a long period of time is obtained.

Hereinafter, as an example of the supercharger component, a nozzle vane for a turbocharger (hereinafter also referred to in short as "nozzle vane") will be described.

Figure 5:
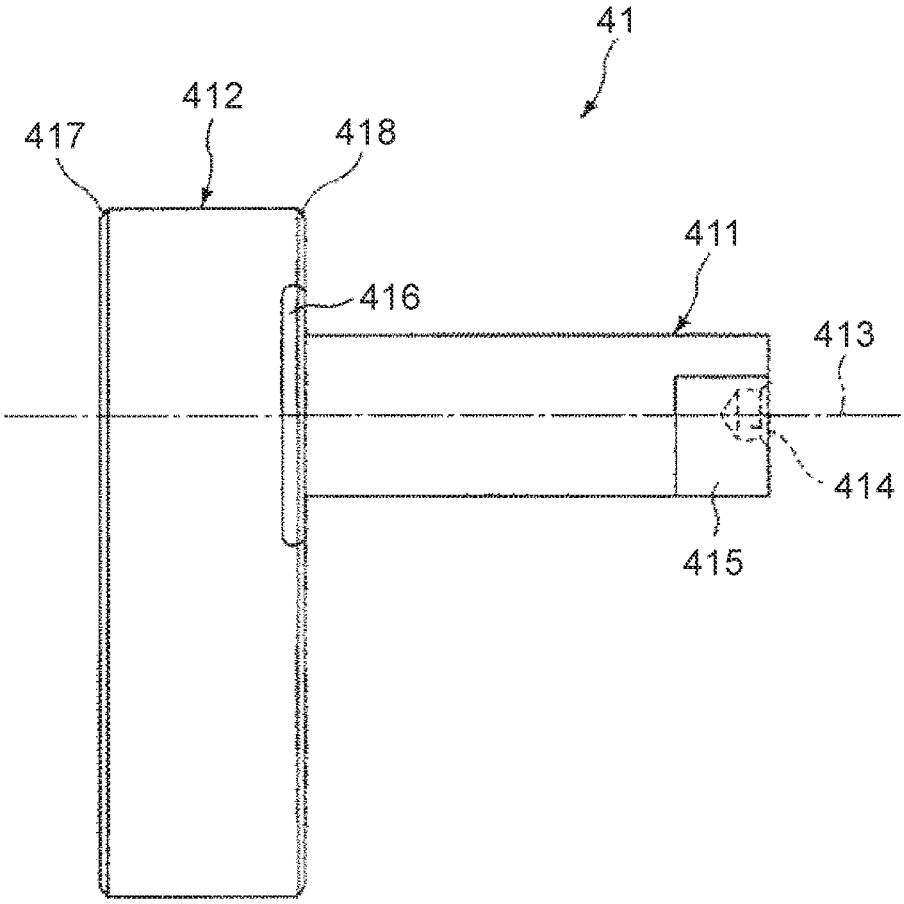
FIG. 5 is a side view showing a nozzle vane for a turbocharger (a view when a blade section is viewed in a plan view).
Figure 6:
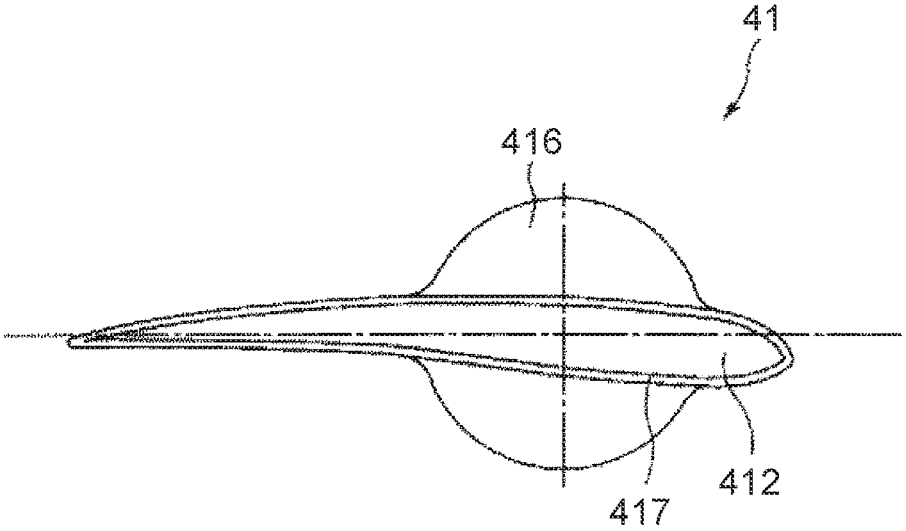
FIG. 6 is a plan view of the nozzle vane shown in FIG. 5.
Figure 7:
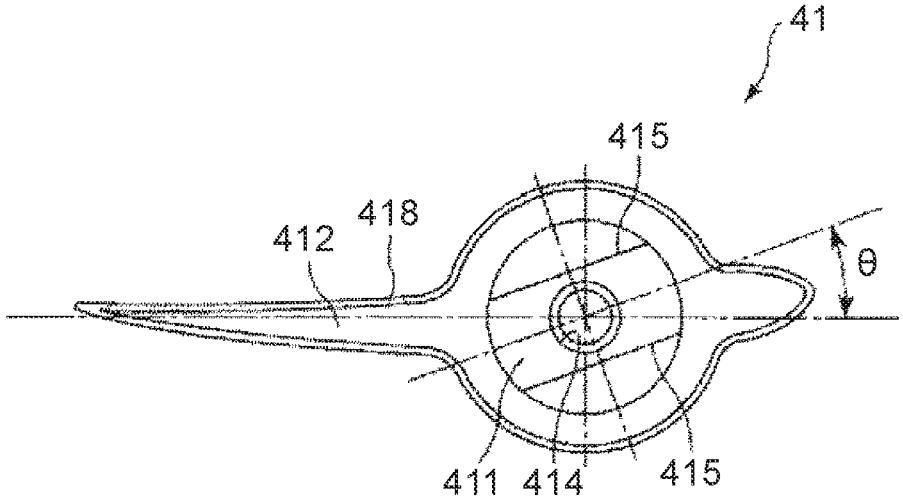
FIG. 7 is a rear view of the nozzle vane shown in FIG. 5.

FIG. 5 is a side view showing a nozzle vane for a turbocharger (a view when a blade section is viewed in a plan view), FIG. 6 is a plan view of the nozzle vane shown in FIG. 5, and FIG. 7 is a rear view of the nozzle vane shown in FIG. 5.

A nozzle vane 41 shown in FIG. 5 includes a shaft section 411 and a blade section 412.

The shaft section 411 is configured such that the transverse cross-sectional shape of the main section is a circle with an axial line 413 as the central axis. This shaft section 411 is configured such that a portion on the blade section 412 side (the left side in FIG. 5) is rotatably supported by a nozzle mount (not shown), and a portion on the opposite side to the blade section 412 (the right side in FIG. 5) is fixed to a nozzle plate (not shown).

Then, a center hole 414 is formed on one end face (an end face on the right side in FIG. 5) of the shaft section 411. This center hole 414 is formed such that the transverse cross-sectional shape thereof is a circle and the center thereof coincides with the axial line 413.

Further, the outer peripheral surface on one end side (the right side in FIG. 5) of the shaft section 411 is provided with a pair of flat sections 415 (a two-side cut section) facing each other through the axial line 413 (see FIG. 7).

Each of such flat sections 415 is used in a state of being in contact with a contact face formed on a lever plate (not shown). A rotation angle around the axial line 413 of the shaft section 411 is regulated, so that a rotation angle around the shaft section 411 of the nozzle vane 41 can be highly accurately adjusted. Further, each flat section 415 is formed so as to be inclined at an angle θ with respect to the protruding direction (blade surface) of the blade section 412 (see FIG. 7).

On the other hand, on the other end side (an end portion on the left side in FIG. 5) of the shaft section 411, the blade section 412 is provided. That is, the blade section 412 is provided so as to protrude from the one end portion of the shaft section 411.

Further, on the other end side of the shaft section 411, a flange section 416 protruding outside the shaft section 411 is formed.

Such a blade section 412 has a strip shape extending in a direction perpendicular to the axial line 413 of the shaft section 411 as shown in FIG. 5 in a plan view. Further, the length of the protrusion of the blade section 412 from the shaft section 411 on one end side (the lower side in FIG. 5) is longer than the other end side (the upper side in FIG. 5).

Further, chamfers 417 and 418 are formed in edge portions in both end portions in the width direction (the lateral direction in FIG. 5) in a plan view of the blade section 412.

Further, as shown in FIGS. 6 and 7, the blade section 412 is slightly curved in the thickness direction. In addition, the thickness of the blade section 412 gradually decreases toward each end in the extending direction (protruding direction).

The nozzle vane 41 as described above is constituted by the sintered body of the invention. Since the sintered body of the invention has a high density, the nozzle vane 41 has excellent mechanical properties, and also has excellent wear resistance. As a result, a supercharger having excellent durability over a long period of time can be realized.

Hereinabove, the metal powder for powder metallurgy, the compound, the granulated powder, the sintered body, and the ornament of the invention have been described with reference to preferred embodiments, however, the invention is not limited thereto.

Further, the sintered body of the invention is used for, for example, components for transport machinery such as components for automobiles, components for bicycles, components for railroad cars, components for ships, components for airplanes, and components for space transport machinery (such as rockets), components for electronic devices such as components for personal computers and components for cellular phone terminals, components for electrical devices such as refrigerators, washing machines, and cooling and heating machines, components for machines such as machine tools and semiconductor production devices, components for plants such as atomic power plants, thermal power plants, hydroelectric power plants, oil refinery plants, and chemical complexes, ornaments such as components for timepieces, metallic eating utensils, jewels, and frames for glasses, medical devices such as surgical instruments, artificial bones, artificial teeth, artificial dental roots, and orthodontic components, and all other sorts of structural components.

EXAMPLES

Next, Examples of the invention will be described.

1. Production of Sintered Body (Zr—Nb Based)

(Sample No. 1)

[1] First, a metal powder having a composition shown in Table 1 produced by a water atomization method was prepared.

Further, the composition of the powder shown in Table 1 was identified and quantitatively determined by inductively coupled high-frequency plasma optical emission spectrometry (ICP analysis method). In the ICP analysis, an ICP device (model: CIROS-120) manufactured by Rigaku Corporation was used. Further, in the identification and quantitative determination of C, a carbon-sulfur analyzer (CS-200) manufactured by LECO Corporation was used. Further, in the identification and quantitative determination of O, an oxygen-nitrogen analyzer (TC-300/EF-300) manufactured by LECO Corporation was used.

[2] Subsequently, the metal powder and a mixture (organic binder) of polypropylene and a wax were weighed at a mass ratio of 9:1 and mixed with each other, whereby a mixed raw material was obtained.

[3] Subsequently, this mixed raw material was kneaded using a kneader, whereby a compound was obtained.

[4] Subsequently, this compound was molded using an injection molding machine under the following molding conditions, whereby a molded body was produced.

<Molding Conditions>

Material temperature: 150° C.

Injection pressure: 11 MPa (110 kgf/cm$^2$)

[5] Subsequently, the obtained molded body was subjected to a heat treatment (degreasing treatment) under the following degreasing conditions, whereby a degreased body was obtained.

<Degreasing Conditions>

Degreasing temperature: 500° C.

Degreasing time: 1 hour (retention time at the degreasing temperature)

Degreasing atmosphere: nitrogen atmosphere

[6] Subsequently, the obtained degreased body was fired under the following firing conditions, whereby a sintered body was obtained. The shape of the sintered body was determined to be a cylindrical shape with a diameter of 10 mm and a thickness of 5 mm.

<Firing Conditions>

Firing temperature: 1200° C.

Firing time: 3 hours (retention time at the firing temperature)

Firing atmosphere: argon atmosphere (Sample Nos. 2 to 29)

Sintered bodies were obtained in the same manner as the method for producing the sintered body of sample No. 1 except that the composition and the like of the metal powder for powder metallurgy were changed as shown in Table 1, respectively. Incidentally, the sintered body of sample No. 29 was obtained by performing an HIP treatment under the following conditions after firing. Further, the sintered bodies of sample Nos. 14 to 16 were obtained using the metal powder produced by a gas atomization method, respectively. Incidentally, "Gas" is entered in the column of Remarks in Table 1.

<HIP Treatment Conditions>

Heating temperature: 1100° C.

Heating time: 2 hours

Applied pressure: 100 MPa

TABLE 1

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (Zr) mass % | E2 (Nb) | Fe | O | Co | E1/E2 — | E1 + E2 mass % | (E1 + E2)/Si — | Si/Mo — | Remarks — |
| No. 1 | Ex. | 28.55 | 6.06 | 0.70 | 0.180 | 0.010 | 0.12 | 0.10 | 0.08 | 0.23 | remainder | 1.20 | 0.22 | 0.31 | 0.12 | |
| No. 2 | Ex. | 29.62 | 5.54 | 0.56 | 0.156 | 0.021 | 0.08 | 0.09 | 0.12 | 0.31 | remainder | 0.89 | 0.17 | 0.30 | 0.10 | |
| No. 3 | Ex. | 27.38 | 6.85 | 0.85 | 0.215 | 0.038 | 0.15 | 0.09 | 0.05 | 0.19 | remainder | 1.67 | 0.24 | 0.28 | 0.12 | |
| No. 4 | Ex. | 28.34 | 5.89 | 0.32 | 0.176 | 0.012 | 0.03 | 0.05 | 0.22 | 0.38 | remainder | 0.60 | 0.08 | 0.25 | 0.05 | |
| No. 5 | Ex. | 27.79 | 6.97 | 1.38 | 0.238 | 0.045 | 0.24 | 0.21 | 0.09 | 0.21 | remainder | 1.14 | 0.45 | 0.33 | 0.20 | |
| No. 6 | Ex. | 28.81 | 5.23 | 0.65 | 0.124 | 0.050 | 0.13 | 0.15 | 0.09 | 0.28 | remainder | 0.87 | 0.28 | 0.43 | 0.12 | |
| No. 7 | Ex. | 29.14 | 4.76 | 0.72 | 0.365 | 0.080 | 0.09 | 0.10 | 0.25 | 0.45 | remainder | 0.90 | 0.19 | 0.26 | 0.15 | |
| No. 8 | Ex. | 33.25 | 4.56 | 0.86 | 0.105 | 0.000 | 0.06 | 0.05 | 0.15 | 0.48 | remainder | 1.20 | 0.11 | 0.13 | 0.19 | |
| No. 9 | Ex. | 26.57 | 6.89 | 0.79 | 0.000 | 0.029 | 0.06 | 0.03 | 0.03 | 0.15 | remainder | 2.00 | 0.09 | 0.11 | 0.11 | |

TABLE 1-continued

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (Zr) mass % | E2 (Nb) | Fe | O | Co | E1/E2 — | E1 + E2 mass % | (E1 + E2)/Si — | Si/Mo — | Remarks — |
| No. 10 | Ex. | 20.21 | 10.32 | 0.75 | 0.031 | 0.012 | 0.07 | 0.08 | 0.38 | 0.24 | remainder | 0.88 | 0.15 | 0.20 | 0.07 | Ni: 35.26 Mn: 0.09 |
| No. 11 | Ex. | 19.34 | 0.00 | 0.67 | 0.036 | 0.090 | 0.10 | 0.11 | 0.46 | 0.46 | remainder | 0.91 | 0.21 | 0.31 | — | Ni: 10.12 Mn: 1.54 W: 15.12 |
| No. 12 | Ex. | 29.41 | 0.00 | 0.74 | 0.025 | 0.223 | 0.15 | 0.11 | 0.95 | 0.51 | remainder | 1.36 | 0.26 | 0.35 | — | Ni: 9.78 W: 7.14 |
| No. 13 | Ex. | 25.64 | 0.00 | 0.67 | 0.041 | 0.186 | 0.13 | 0.11 | 0.95 | 0.46 | remainder | 1.18 | 0.24 | 0.36 | — | Ni: 10.45 W: 6.79 |
| No. 14 | Ex. | 28.46 | 6.12 | 0.68 | 0.221 | 0.014 | 0.15 | 0.12 | 0.05 | 0.28 | remainder | 1.25 | 0.27 | 0.40 | 0.11 | Gas |
| No. 15 | Ex. | 29.77 | 5.41 | 0.58 | 0.152 | 0.023 | 0.08 | 0.06 | 0.15 | 0.33 | remainder | 1.33 | 0.14 | 0.24 | 0.11 | Gas |
| No. 16 | Ex. | 27.46 | 6.94 | 0.86 | 0.208 | 0.034 | 0.07 | 0.05 | 0.08 | 0.19 | remainder | 1.40 | 0.12 | 0.14 | 0.12 | Gas |
| No. 17 | Comp. Ex. | 28.46 | 6.11 | 0.72 | 0.185 | 0.011 | 0.00 | 0.09 | 0.07 | 0.22 | remainder | 0.00 | 0.09 | 0.13 | 0.12 | |
| No. 18 | Comp. Ex. | 29.54 | 5.47 | 0.61 | 0.157 | 0.031 | 0.09 | 0.00 | 0.13 | 0.32 | remainder | — | 0.09 | 0.15 | 0.11 | |
| No. 19 | Comp. Ex. | 27.45 | 6.92 | 0.84 | 0.221 | 0.025 | 0.00 | 0.00 | 0.08 | 0.19 | remainder | — | 0.00 | 0.00 | 0.12 | |
| No. 20 | Comp. Ex. | 28.41 | 6.31 | 0.71 | 0.197 | 0.014 | 0.75 | 0.12 | 0.15 | 0.41 | remainder | 6.25 | 0.87 | 1.23 | 0.11 | |
| No. 21 | Comp. Ex. | 27.97 | 5.87 | 0.65 | 0.158 | 0.023 | 0.08 | 0.78 | 0.22 | 0.36 | remainder | 0.10 | 0.86 | 1.32 | 0.11 | |
| No. 22 | Comp. Ex. | 28.65 | 6.42 | 0.17 | 0.194 | 0.034 | 0.07 | 0.05 | 0.03 | 0.15 | remainder | 1.40 | 0.12 | 0.71 | 0.03 | |
| No. 23 | Comp. Ex. | 28.69 | 5.91 | 2.29 | 0.112 | 0.060 | 0.06 | 0.07 | 0.09 | 0.16 | remainder | 0.86 | 0.13 | 0.06 | 0.39 | |
| No. 24 | Comp. Ex. | 26.75 | 6.98 | 0.97 | 0.000 | 0.027 | 0.00 | 0.03 | 0.05 | 0.13 | remainder | — | 0.03 | 0.03 | — | |
| No. 25 | Comp. Ex. | 20.34 | 10.41 | 0.45 | 0.025 | 0.011 | 0.07 | 0.00 | 0.09 | 0.24 | remainder | — | 0.07 | 0.16 | — | Ni: 35.47 Mn: 0.11 |
| No. 26 | Comp. Ex. | 19.36 | 0.00 | 0.78 | 0.035 | 0.087 | 0.08 | 0.00 | 0.12 | 0.27 | remainder | — | 0.08 | 0.10 | — | Ni: 10.23 Mn: 1.48 W: 14.82 |
| No. 27 | Comp. Ex. | 29.54 | 0.00 | 0.72 | 0.023 | 0.215 | 0.15 | 0.00 | 0.89 | 0.42 | remainder | — | 0.15 | 0.21 | — | Ni: 9.65 W: 6.87 |
| No. 28 | Comp. Ex. | 25.53 | 0.00 | 0.65 | 0.039 | 0.174 | 0.13 | 0.00 | 0.93 | 0.47 | remainder | — | 0.13 | 0.20 | — | Ni: 10.21 W: 6.64 |
| No. 29 | Comp. Ex. | 28.46 | 6.11 | 0.72 | 0.185 | 0.011 | 0.00 | 0.09 | 0.07 | 0.22 | remainder | 0.00 | 0.09 | 0.13 | 0.12 | HIP treatment |

Incidentally, in Table 1, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 1 is omitted.

(Sample No. 30)

[1] First, a metal powder having a composition shown in Table 2 was produced by a water atomization method in the same manner as in the case of sample No. 1.

[2] Subsequently, the metal powder was granulated by a spray drying method. The binder used at this time was polyvinyl alcohol, which was used in an amount of 1 part by mass with respect to 100 parts by mass of the metal powder. Further, a solvent (ion exchanged water) was used in an amount of 50 parts by mass with respect to 1 part by mass of polyvinyl alcohol. In this manner, a granulated powder having an average particle diameter of 50 μm was obtained.

[3] Subsequently, this granulated powder was subjected to powder compaction molding under the following molding conditions. In this molding, a press molding machine was used. The shape of the molded body to be produced was determined to be a cubic shape with a side length of 20 mm.

<Molding Conditions>

Material temperature: 90° C.

Molding pressure: 600 MPa (6 t/cm$^2$)

[4] Subsequently, the obtained molded body was subjected to a heat treatment (degreasing treatment) under the following degreasing conditions, whereby a degreased body was obtained.

<Degreasing Conditions>

Degreasing temperature: 450° C.

Degreasing time: 2 hours (retention time at the degreasing temperature)

Degreasing atmosphere: nitrogen atmosphere

[5] Subsequently, the obtained degreased body was fired under the following firing conditions, whereby a sintered body was obtained.

<Firing Conditions>

Firing temperature: 1200° C.

Firing time: 3 hours (retention time at the firing temperature)

Firing atmosphere: argon atmosphere

[6] Subsequently, the obtained sintered body was sequentially subjected to a solid solution heat treatment and a precipitation hardening heat treatment under the following conditions.

<Conditions for Solid Solution Heat Treatment>

Heating temperature: 1050° C.

Heating time: 10 minutes

Cooling method: water cooling

<Conditions for Precipitation Hardening Heat Treatment>

Heating temperature: 480° C.

Heating time: 60 minutes

Cooling method: air cooling (Sample Nos. 31 to 40)

Sintered bodies were obtained in the same manner as in the case of sample No. 30 except that the composition and the like of the metal powder for powder metallurgy were changed as shown in Table 2, respectively. Incidentally, the sintered body of sample No. 40 was obtained by performing an HIP treatment under the following conditions after firing.

<HIP Treatment Conditions>

Heating temperature: 1100° C.

Heating time: 2 hours

Applied pressure: 100 MPa

<Evaluation Criteria for Vickers Hardness>

A: The Vickers hardness is 300 or more.

F: The Vickers hardness is less than 300.

The evaluation results are shown in Tables 3 and 4.

TABLE 2

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (Zr) mass % | E2 (Nb) | Fe | O | Co | E1/E2 — | E1 + E2 mass % | (E1 + E2)/Si — | Si/Mo — | Remarks — |
| No. 30 | Ex. | 28.55 | 6.06 | 0.70 | 0.180 | 0.01 | 0.12 | 0.10 | 0.08 | 0.23 | remainder | 1.20 | 0.22 | 0.31 | 0.12 | Powder compaction |
| No. 31 | Ex. | 29.62 | 5.54 | 0.58 | 0.156 | 0.02 | 0.08 | 0.09 | 0.12 | 0.31 | remainder | 0.89 | 0.17 | 0.30 | 0.10 | Powder compaction |
| No. 32 | Ex. | 27.38 | 6.85 | 0.85 | 0.215 | 0.04 | 0.15 | 0.09 | 0.05 | 0.19 | remainder | 1.67 | 0.24 | 0.28 | 0.12 | Powder compaction |
| No. 33 | Ex. | 28.34 | 5.39 | 0.32 | 0.176 | 0.01 | 0.03 | 0.05 | 0.22 | 0.38 | remainder | 0.60 | 0.08 | 0.25 | 0.05 | Powder compaction |
| No. 34 | Ex. | 27.79 | 6.97 | 1.38 | 0.238 | 0.05 | 0.24 | 0.21 | 0.09 | 0.21 | remainder | 1.14 | 0.45 | 0.33 | 0.20 | Powder compaction |
| No. 35 | Comp. Ex. | 28.46 | 6.11 | 0.72 | 0.185 | 0.01 | 0.00 | 0.09 | 0.07 | 0.22 | remainder | 0.00 | 0.09 | 0.13 | 0.12 | Powder compaction |
| No. 36 | Comp. Ex. | 29.54 | 5.47 | 0.61 | 0.157 | 0.03 | 0.09 | 0.00 | 0.13 | 0.32 | remainder | — | 0.09 | 0.15 | 0.11 | Powder compaction |
| No. 37 | Comp. Ex. | 27.45 | 6.92 | 0.84 | 0.221 | 0.03 | 0.00 | 0.00 | 0.08 | 0.19 | remainder | — | 0.00 | 0.00 | 0.12 | Powder compaction |
| No. 38 | Comp. Ex. | 28.41 | 6.31 | 0.71 | 0.197 | 0.01 | 0.75 | 0.12 | 0.15 | 0.41 | remainder | 6.25 | 0.87 | 1.23 | 0.11 | Powder compaction |
| No. 39 | Comp. Ex. | 27.97 | 5.87 | 0.65 | 0.158 | 0.02 | 0.08 | 0.78 | 0.22 | 0.36 | remainder | 0.10 | 0.86 | 1.32 | 0.11 | Powder compaction |
| No. 40 | Comp. Ex. | 28.46 | 6.11 | 0.72 | 0.185 | 0.01 | 0.00 | 0.09 | 0.07 | 0.22 | remainder | 0.00 | 0.09 | 0.13 | 0.12 | HIP treatment |

Incidentally, in Table 2, among the metal powders for powder metallurgy and the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 2 is omitted.

2. Evaluation of Sintered Body (Zr—Nb Based)

2.1 Evaluation of Relative Density

With respect to the sintered bodies of the respective sample Nos. shown in Tables 1 and 2, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Tables 3 and 4.

2.2 Evaluation of Hardness

With respect to the sintered bodies of the respective sample Nos. shown in Tables 1 and 2, the Vickers hardness was measured in accordance with the Vickers hardness test method specified in JIS Z 2244 (2009).

Then, the measured hardness was evaluated according to the following evaluation criteria.

2.3 Evaluation of Tensile Strength, 0.2% Proof Stress, and Elongation

With respect to the sintered bodies of the respective sample Nos. shown in Tables 1 and 2, the tensile strength, 0.2% proof stress, and elongation were measured in accordance with the metal material tensile test method specified in JIS Z 2241 (2011).

Then, these measured physical property values were evaluated according to the following evaluation criteria.

<Evaluation Criteria for Tensile Strength>

A: The tensile strength of the sintered body is 695 MPa or more.

B: The tensile strength of the sintered body is 685 MPa or more and less than 695 MPa.

C: The tensile strength of the sintered body is 675 MPa or more and less than 685 MPa.

D: The tensile strength of the sintered body is 665 MPa or more and less than 675 MPa.

E: The tensile strength of the sintered body is 655 MPa or more and less than 665 MPa.

F: The tensile strength of the sintered body is less than 655 MPa.

<Evaluation Criteria for 0.2% Proof Stress>

A: The 0.2% proof stress of the sintered body is 490 MPa or more.

B: The 0.2% proof stress of the sintered body is 480 MPa or more and less than 490 MPa.

C: The 0.2% proof stress of the sintered body is 470 MPa or more and less than 480 MPa.

D: The 0.2% proof stress of the sintered body is 460 MPa or more and less than 470 MPa.

E: The 0.2% proof stress of the sintered body is 450 MPa or more and less than 460 MPa.

F: The 0.2% proof stress of the sintered body is less than 450 MPa.

<Evaluation Criteria for Elongation>

A: The elongation of the sintered body is 16% or more.

B: The elongation of the sintered body is 14% or more and less than 16%.

C: The elongation of the sintered body is 12% or more and less than 14%.

D: The elongation of the sintered body is 10% or more and less than 12%.

E: The elongation of the sintered body is 8% or more and less than 10%.

F: The elongation of the sintered body is less than 8%.

The above evaluation results are shown in Tables 3 and 4.

2.4 Evaluation of Fatigue Strength

With respect to the sintered bodies of the respective sample Nos. shown in Tables 1 and 2, the fatigue strength was measured.

Incidentally, the fatigue strength was measured in accordance with the test method specified in JIS Z 2273 (1978). Further, the waveform of an applied load corresponding to a repeated stress was set to an alternating sine wave, and the minimum/maximum stress ratio (minimum stress/maximum stress) was set to 0.1. Further, the repeated frequency was set to 30 Hz, and the repeat count was set to $1\times10^7$.

Then, the measured fatigue strength was evaluated according to the following evaluation criteria.

<Evaluation Criteria for Fatigue Strength>

A: The fatigue strength of the sintered body is 430 MPa or more.

B: The fatigue strength of the sintered body is 410 MPa or more and less than 430 MPa.

C: The fatigue strength of the sintered body is 390 MPa or more and less than 410 MPa.

D: The fatigue strength of the sintered body is 370 MPa or more and less than 390 MPa.

E: The fatigue strength of the sintered body is 350 MPa or more and less than 370 MPa.

F: The fatigue strength of the sintered body is less than 350 MPa.

The above evaluation results are shown in Tables 3 and 4.

TABLE 3

| | | Metal powder | Evaluation results of sintered body | | | | | |
|---|---|---|---|---|---|---|---|---|
| Sample No. | — | Average particle diameter μm | Relative density % | Vickers hardness — | Tensile strength — | 0.2% proof stress — | Elongation — | Fatigue strength — |
| No. 1 | Ex. | 4.12 | 99.5 | A | A | A | A | A |
| No. 2 | Ex. | 3.79 | 99.4 | A | A | A | A | A |
| No. 3 | Ex. | 4.23 | 99.3 | A | A | A | A | A |
| No. 4 | Ex. | 10.23 | 98.3 | A | B | B | C | B |
| No. 5 | Ex. | 9.56 | 98.6 | A | B | B | B | B |
| No. 6 | Ex. | 16.35 | 98.1 | A | B | B | B | B |
| No. 7 | Ex. | 24.21 | 97.7 | A | B | B | C | B |
| No. 8 | Ex. | 2.15 | 98.7 | A | A | A | A | A |
| No. 9 | Ex. | 3.64 | 98.9 | A | B | B | A | B |
| No. 10 | Ex. | 3.78 | 99.2 | A | A | A | A | A |
| No. 11 | Ex. | 4.59 | 99.1 | A | A | A | A | A |
| No. 12 | Ex. | 6.87 | 98.8 | A | A | A | A | B |
| No. 13 | Ex. | 7.54 | 99.0 | A | A | A | A | A |
| No. 14 | Ex. | 11.23 | 99.2 | A | A | A | A | A |
| No. 15 | Ex. | 10.56 | 99.0 | A | A | A | A | B |
| No. 16 | Ex. | 14.23 | 99.1 | A | A | A | A | A |
| No. 17 | Comp. Ex. | 4.25 | 96.8 | A | B | C | C | D |
| No. 18 | Comp. Ex. | 3.98 | 96.9 | A | C | C | B | C |
| No. 19 | Comp. Ex. | 4.36 | 96.2 | A | E | E | C | E |
| No. 20 | Comp. Ex. | 10.34 | 95.2 | A | D | D | D | D |
| No. 21 | Comp. Ex. | 10.21 | 95.3 | A | D | D | E | D |
| No. 22 | Comp. Ex. | 16.89 | 95.8 | A | C | C | D | C |
| No. 23 | Comp. Ex. | 23.41 | 95.1 | A | D | D | E | D |
| No. 24 | Comp. Ex. | 3.58 | 96.8 | A | E | E | C | E |
| No. 25 | Comp. Ex. | 3.84 | 96.7 | A | C | C | C | C |
| No. 26 | Comp. Ex. | 4.58 | 96.6 | A | C | C | C | C |
| No. 27 | Comp. Ex. | 6.89 | 96.4 | A | D | D | C | D |
| No. 28 | Comp. Ex. | 7.48 | 96.5 | A | C | C | C | C |
| No. 29 | Comp. Ex. | 4.25 | 98.9 | A | A | A | B | B |

TABLE 4

| Sample No. | — | Metal powder: Average particle diameter μm | Evaluation results of sintered body: Relative density % | Vickers hardness — | Tensile strength — | 0.2% proof stress — | Elongation — | Fatigue strength — |
|---|---|---|---|---|---|---|---|---|
| No. 30 | Ex. | 4.12 | 99.3 | A | A | A | A | A |
| No. 31 | Ex. | 3.79 | 99.2 | A | A | A | A | A |
| No. 32 | Ex. | 4.23 | 99.1 | A | A | A | A | A |
| No. 33 | Ex. | 10.23 | 98.2 | A | B | B | B | B |
| No. 34 | Ex. | 9.56 | 98.5 | A | B | B | B | B |
| No. 35 | Comp. Ex. | 4.25 | 96.7 | A | B | C | C | D |
| No. 36 | Comp. Ex. | 3.98 | 96.8 | A | D | D | B | D |
| No. 37 | Comp. Ex. | 4.36 | 96.2 | A | E | E | C | E |
| No. 38 | Comp. Ex. | 10.34 | 94.9 | A | D | D | D | D |
| No. 39 | Comp. Ex. | 10.21 | 94.8 | A | D | D | E | D |
| No. 40 | Comp. Ex. | 4.25 | 98.9 | A | A | A | B | B |

As apparent from Tables 3 and 4, it was confirmed that the sintered bodies corresponding to Example each have a higher relative density than the sintered bodies corresponding to Comparative Example (excluding the sintered bodies having undergone the HIP treatment). It was also confirmed that there is a significant difference in properties such as tensile strength, 0.2% proof stress, and elongation between them.

On the other hand, when the respective physical property values were compared between the sintered bodies corresponding to Example and the sintered bodies having undergone the HIP treatment, it was confirmed that the physical property values are all comparable to each other.

3. Production of Sintered Body (Hf—Nb Based) (Sample Nos. 41 to 69)

Sintered bodies were obtained in the same manner as the method for producing the sintered body of sample No. 1 except that the composition and the like of the metal powder for powder metallurgy were changed as shown in Table 5, respectively. Further, the sintered body of sample No. 69 was obtained by performing an HIP treatment under the following conditions after firing.

<HIP Treatment Conditions>

Heating temperature: 1100° C.

Heating time: 2 hours

Applied pressure: 100 MPa

TABLE 5

| Sample No. | — | Metal powder for powder metallurgy: Alloy composition: Cr (mass %) | Mo | Si | N | C | E1 (Hf) | E2 (Nb) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 41 | Ex. | 28.48 | 6.15 | 0.70 | 0.182 | 0.012 | 0.15 | 0.09 | 0.07 | 0.25 | remainder | 1.67 | 0.24 | 0.34 | 0.11 | |
| No. 42 | Ex. | 29.75 | 5.51 | 0.53 | 0.162 | 0.024 | 0.08 | 0.04 | 0.12 | 0.31 | remainder | 2.00 | 0.12 | 0.23 | 0.10 | |
| No. 43 | Ex. | 27.38 | 6.85 | 0.85 | 0.215 | 0.038 | 0.09 | 0.09 | 0.07 | 0.21 | remainder | 1.00 | 0.18 | 0.21 | 0.12 | |
| No. 44 | Ex. | 28.45 | 5.83 | 0.33 | 0.179 | 0.018 | 0.05 | 0.03 | 0.20 | 0.41 | remainder | 1.67 | 0.08 | 0.24 | 0.06 | |
| No. 45 | Ex. | 27.85 | 6.91 | 1.34 | 0.231 | 0.048 | 0.21 | 0.16 | 0.07 | 0.18 | remainder | 1.31 | 0.37 | 0.28 | 0.19 | |
| No. 46 | Ex. | 28.79 | 5.18 | 0.63 | 0.118 | 0.056 | 0.13 | 0.05 | 0.09 | 0.25 | remainder | 2.60 | 0.18 | 0.29 | 0.12 | |
| No. 47 | Ex. | 29.25 | 4.71 | 0.74 | 0.368 | 0.089 | 0.10 | 0.08 | 0.23 | 0.42 | remainder | 1.25 | 0.18 | 0.24 | 0.16 | |
| No. 48 | Ex. | 33.38 | 4.65 | 0.87 | 0.114 | 0.000 | 0.07 | 0.04 | 0.25 | 0.48 | remainder | 1.75 | 0.11 | 0.13 | 0.19 | |
| No. 49 | Ex. | 26.74 | 6.82 | 0.78 | 0.000 | 0.035 | 0.18 | 0.09 | 0.05 | 0.16 | remainder | 2.00 | 0.27 | 0.35 | 0.11 | |
| No. 50 | Ex. | 20.34 | 10.28 | 0.73 | 0.039 | 0.015 | 0.09 | 0.05 | 0.35 | 0.21 | remainder | 1.80 | 0.14 | 0.19 | 0.07 | Ni: 35.26<br>Mn: 0.09 |
| No. 51 | Ex. | 19.41 | 0.00 | 0.65 | 0.043 | 0.089 | 0.12 | 0.05 | 0.39 | 0.25 | remainder | 2.40 | 0.17 | 0.26 | — | Ni: 10.12<br>Mn: 1.54<br>W: 15.12 |
| No. 52 | Ex. | 29.51 | 0.00 | 0.88 | 0.029 | 0.219 | 0.15 | 0.08 | 0.93 | 0.54 | remainder | 1.88 | 0.23 | 0.26 | — | Ni: 9.78<br>W: 7.14 |
| No. 53 | Ex. | 25.46 | 0.00 | 0.76 | 0.018 | 0.175 | 0.11 | 0.13 | 0.89 | 0.45 | remainder | 0.85 | 0.24 | 0.32 | — | Ni: 10.45<br>W: 6.79 |
| No. 54 | Ex. | 28.43 | 6.22 | 0.67 | 0.204 | 0.012 | 0.15 | 0.11 | 0.06 | 0.24 | remainder | 1.36 | 0.26 | 0.39 | 0.11 | Gas |
| No. 55 | Ex. | 29.65 | 5.36 | 0.56 | 0.158 | 0.025 | 0.09 | 0.05 | 0.18 | 0.28 | remainder | 1.80 | 0.14 | 0.25 | 0.10 | Gas |
| No. 56 | Ex. | 27.63 | 6.89 | 0.85 | 0.198 | 0.028 | 0.08 | 0.05 | 0.11 | 0.16 | remainder | 1.60 | 0.13 | 0.15 | 0.12 | Gas |
| No. 57 | Comp. Ex. | 28.38 | 6.07 | 0.75 | 0.189 | 0.010 | 0.00 | 0.07 | 0.06 | 0.26 | remainder | 0.00 | 0.07 | 0.09 | 0.12 | |
| No. 58 | Comp. Ex. | 29.58 | 5.43 | 0.59 | 0.155 | 0.029 | 0.08 | 0.00 | 0.11 | 0.33 | remainder | — | 0.08 | 0.14 | 0.11 | |
| No. 59 | Comp. Ex. | 27.46 | 6.94 | 0.83 | 0.235 | 0.024 | 0.00 | 0.00 | 0.13 | 0.17 | remainder | — | 0.00 | 0.00 | 0.12 | |
| No. 60 | Comp. Ex. | 28.34 | 5.97 | 0.75 | 0.203 | 0.013 | 0.81 | 0.11 | 0.16 | 0.38 | remainder | 7.36 | 0.92 | 1.23 | 0.13 | |
| No. 61 | Comp. Ex. | 27.92 | 5.66 | 0.62 | 0.148 | 0.028 | 0.18 | 0.71 | 0.18 | 0.17 | remainder | 0.25 | 0.89 | 1.44 | 0.11 | |
| No. 62 | Comp. Ex. | 28.54 | 836 | 0.14 | 0.199 | 0.011 | 0.08 | 0.04 | 0.02 | 0.21 | remainder | 2.00 | 0.12 | 0.86 | 0.02 | |
| No. 63 | Comp. Ex. | 28.79 | 5.87 | 2.34 | 0.123 | 0.078 | 0.06 | 0.06 | 0.08 | 0.15 | remainder | 1.00 | 0.12 | 0.05 | 0.40 | |
| No. 64 | Comp. Ex. | 26.77 | 7.10 | 0.96 | 0.000 | 0.028 | 0.00 | 0.05 | 0.09 | 0.18 | remainder | — | 0.05 | 0.05 | — | |
| No. 65 | Comp. Ex. | 20.55 | 10.32 | 0.48 | 0.024 | 0.016 | 0.12 | 0.00 | 0.11 | 0.19 | remainder | — | 0.12 | 0.25 | — | Ni: 35.47<br>Mn: 0.11 |

TABLE 5-continued

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (Hf) mass % | E2 (Nb) | Fe | O | Co | E1/E2 — | E1 + E2 mass % | (E1 + E2)/Si — | Si/Mo — | Remarks — |
| No. 66 | Comp. Ex. | 19.46 | 0.00 | 0.79 | 0.037 | 0.091 | 0.09 | 0.00 | 0.13 | 0.28 | remainder | — | 0.09 | 0.11 | — | Ni: 10.23 Mn: 1.48 W: 14.82 |
| No. 67 | Comp. Ex. | 29.44 | 0.00 | 0.73 | 0.021 | 0.205 | 0.16 | 0.00 | 0.85 | 0.35 | remainder | — | 0.16 | 0.22 | — | Ni: 9.65 W: 6.87 |
| No. 68 | Comp. Ex. | 25.69 | 0.00 | 0.64 | 0.037 | 0.171 | 0.12 | 0.00 | 0.88 | 0.43 | remainder | — | 0.12 | 0.19 | — | Ni: 10.21 W: 6.64 |
| No. 69 | Comp. Ex. | 28.38 | 6.07 | 0.75 | 0.189 | 0.010 | 0.00 | 0.07 | 0.06 | 0.26 | remainder | 0.00 | 0.07 | 0.09 | 0.12 | HIP treatment |

Incidentally, in Table 5, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 5 is omitted.

4. Evaluation of Sintered Body (Hf—Nb Based)

4.1 Evaluation of Relative Density

With respect to the sintered bodies of the respective sample Nos. shown in Table 5, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 6.

4.2 Evaluation of Hardness

With respect to the sintered bodies of the respective sample Nos. shown in Table 5, the Vickers hardness was measured in accordance with the Vickers hardness test method specified in JIS Z 2244 (2009).

Then, the measured hardness was evaluated according to the evaluation criteria described in 2.2.

The evaluation results are shown in Table 6.

4.3 Evaluation of Tensile Strength, 0.2% Proof Stress, and Elongation

With respect to the sintered bodies of the respective sample Nos. shown in Table 5, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 6.

4.4 Evaluation of Fatigue Strength

With respect to the sintered bodies of the respective sample Nos. shown in Table 5, the fatigue strength was measured in the same manner as in 2.4.

Then, the measured fatigue strength was evaluated according to the evaluation criteria described in 2.4.

The evaluation results are shown in Table 6.

TABLE 6

| | | Metal powder | Evaluation results of sintered body | | | | | |
|---|---|---|---|---|---|---|---|---|
| Sample No. | — | Average particle diameter μm | Relative density % | Vickers hardness — | Tensile strength — | 0.2% proof stress — | Elongation — | Fatigue strength — |
| No. 41 | Ex. | 4.25 | 99.4 | A | A | A | A | A |
| No. 42 | Ex. | 3.84 | 99.3 | A | A | A | A | A |
| No. 43 | Ex. | 4.88 | 99.2 | A | A | A | A | A |
| No. 44 | Ex. | 10.12 | 98.2 | A | B | B | C | B |
| No. 45 | Ex. | 9.21 | 98.5 | A | B | B | B | B |
| No. 46 | Ex. | 16.88 | 98.1 | A | B | B | B | B |
| No. 47 | Ex. | 23.56 | 97.5 | A | B | B | C | B |
| No. 48 | Ex. | 2.09 | 98.6 | A | A | A | A | A |
| No. 49 | Ex. | 2.59 | 98.8 | A | A | A | A | A |
| No. 50 | Ex. | 4.25 | 99.0 | A | A | A | A | A |
| No. 51 | Ex. | 5.63 | 98.9 | A | A | A | A | A |
| No. 52 | Ex. | 6.74 | 98.7 | A | A | A | A | B |
| No. 53 | Ex. | 8.99 | 98.9 | A | A | A | A | A |
| No. 54 | Ex. | 10.25 | 99.1 | A | A | A | A | A |
| No. 55 | Ex. | 12.31 | 99.2 | A | A | A | A | A |
| No. 56 | Ex. | 14.58 | 99.0 | A | A | A | A | A |
| No. 57 | Comp. Ex. | 4.13 | 96.7 | A | B | C | C | C |
| No. 58 | Comp. Ex. | 3.85 | 96.8 | A | C | C | B | C |
| No. 59 | Comp. Ex. | 4.96 | 96.3 | A | E | E | C | E |
| No. 60 | Comp. Ex. | 5.54 | 95.3 | A | D | D | D | D |
| No. 61 | Comp. Ex. | 5.69 | 95.2 | A | D | D | E | D |

TABLE 6-continued

| Sample No. | — | Metal powder Average particle diameter μm | Evaluation results of sintered body Relative density % | Vickers hardness — | Tensile strength — | 0.2% proof stress — | Elongation — | Fatigue strength — |
|---|---|---|---|---|---|---|---|---|
| No. 62 | Comp. Ex. | 4.88 | 95.6 | A | C | C | C | D |
| No. 63 | Comp. Ex. | 4.12 | 95.2 | A | D | D | E | D |
| No. 64 | Comp. Ex. | 2.58 | 96.7 | A | E | E | C | E |
| No. 65 | Comp. Ex. | 4.23 | 96.6 | A | C | C | C | D |
| No. 66 | Comp. Ex. | 5.77 | 96.4 | A | D | D | D | D |
| No. 67 | Comp. Ex. | 6.87 | 96.5 | A | C | C | C | D |
| No. 68 | Comp. Ex. | 8.78 | 96.4 | A | C | C | C | D |
| No. 69 | Comp. Ex. | 4.13 | 99.0 | A | A | A | B | B |

As apparent from Table 6, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

On the other hand, when the respective physical property values were compared between the sintered bodies corresponding to Example and the sintered body having undergone the HIP treatment, it was confirmed that the physical property values are all comparable to each other.

5. Production of Sintered Body (Ti—Nb Based)

(Sample Nos. 70 to 79)

Sintered bodies were obtained in the same manner as the method for producing the sintered body of sample No. 1 except that the composition and the like of the metal powder for powder metallurgy were changed as shown in Table 7, respectively.

(Sample No. 80)

A mixed powder was prepared by mixing a metal powder, a Ti powder having an average particle diameter of 40 μm, and a Nb powder having an average particle diameter of 25 μm. Incidentally, in the preparation of the mixed powder, the mixing amount of each of the metal powder, the Ti powder, and the Nb powder was adjusted so that the composition of the mixed powder was as shown in Table 7.

Subsequently, a sintered body was obtained in the same manner as the method for producing the sintered body of sample No. 1 using this mixed powder.

TABLE 9

| Sample No. | — | Metal powder for powder metallurgy: Alloy composition Cr | Mo | Si | N | C | E1 (Ti) mass % | E2 (Nb) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 70 | Ex. | 28.55 | 6.09 | 0.72 | 0.185 | 0.011 | 0.05 | 0.11 | 0.06 | 0.24 | remainder | 0.45 | 0.16 | 0.22 | 0.12 | |
| No. 71 | Ex. | 29.77 | 5.48 | 0.55 | 0.158 | 0.025 | 0.03 | 0.06 | 0.12 | 0.28 | remainder | 0.50 | 0.09 | 0.16 | 0.10 | |
| No. 72 | Ex. | 27.44 | 6.89 | 0.86 | 0.224 | 0.035 | 0.12 | 0.15 | 0.15 | 0.33 | remainder | 0.80 | 0.27 | 0.31 | 0.12 | |
| No. 73 | Ex. | 20.28 | 10.35 | 0.75 | 0.025 | 0.013 | 0.08 | 0.08 | 0.03 | 0.22 | remainder | 1.00 | 0.16 | 0.21 | 0.07 | Ni: 35.47 Mn: 0.11 |
| No. 74 | Ex. | 19.38 | 0.00 | 0.64 | 0.041 | 0.087 | 0.06 | 0.08 | 0.85 | 0.56 | remainder | 0.75 | 0.14 | 0.22 | — | Ni: 10.35 Mn: 1.47 W: 15.02 |
| No. 75 | Comp. Ex. | 28.29 | 6.01 | 0.76 | 0.182 | 0.012 | 0.00 | 0.11 | 0.08 | 0.29 | remainder | 0.00 | 0.11 | 0.14 | 0.13 | |
| No. 76 | Comp. Ex. | 29.67 | 5.40 | 0.56 | 0.153 | 0.024 | 0.08 | 0.00 | 0.15 | 0.36 | remainder | — | 0.08 | 0.14 | 0.10 | |
| No. 77 | Comp. Ex. | 27.43 | 6.87 | 0.81 | 0.223 | 0.045 | 0.00 | 0.00 | 0.25 | 0.35 | remainder | — | 0.00 | 0.00 | 0.12 | |
| No. 78 | Comp. Ex. | 28.59 | 5.89 | 0.73 | 0.102 | 0.065 | 0.76 | 0.08 | 0.19 | 0.25 | remainder | 9.50 | 0.84 | 1.15 | 0.12 | |
| No. 79 | Comp. Ex. | 27.74 | 5.34 | 0.64 | 0.093 | 0.028 | 0.16 | 0.74 | 0.17 | 0.15 | remainder | 0.22 | 0.90 | 1.41 | 0.12 | |
| No. 80 | Comp. Ex. | 28.34 | 6.21 | 0.77 | 0.192 | 0.012 | 0.15 | 0.22 | 0.07 | 0.28 | remainder | 0.68 | 0.37 | 0.48 | 0.12 | Mixed powder |

Incidentally, in Table 7, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 7 is omitted.

6. Evaluation of Sintered Body (Ti—Nb Based)

6.1 Evaluation of Relative Density

With respect to the sintered bodies of the respective sample Nos. shown in Table 7, the sintered density was measured in accordance with the method for measuring the density of sintered metal materials specified in JIS Z 2501

(2000), and also the relative density of each sintered body was calculated with reference to the true density of the metal powder for powder metallurgy used for producing each sintered body.

The calculation results are shown in Table 8.

6.2 Evaluation of Hardness

With respect to the sintered bodies of the respective sample Nos. shown in Table 7, the Vickers hardness was measured in accordance with the Vickers hardness test method specified in JIS Z 2244 (2009).

Then, the measured hardness was evaluated according to the evaluation criteria described in 2.2.

The evaluation results are shown in Table 8.

6.3 Evaluation of Tensile Strength, 0.2% Proof Stress, and Elongation

With respect to the sintered bodies of the respective sample Nos. shown in Table 7, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 8.

6.4 Evaluation of Fatigue Strength

With respect to the sintered bodies of the respective sample Nos. shown in Table 7, the fatigue strength was measured in the same manner as in 2.4.

Then, the measured fatigue strength was evaluated according to the evaluation criteria described in 2.4.

The evaluation results are shown in Table 8.

TABLE 8

| | | Metal powder | Evaluation results of sintered body | | | | | |
|---|---|---|---|---|---|---|---|---|
| Sample No. | — | Average particle diameter μm | Relative density % | Vickers hardness — | Tensile strength — | 0.2% proof stress — | Elongation — | Fatigue strength — |
| No. 70 | Ex. | 4.78 | 99.3 | A | A | A | A | A |
| No. 71 | Ex. | 3.65 | 99.0 | A | A | A | B | B |
| No. 72 | Ex. | 4.02 | 99.2 | A | A | A | A | A |
| No. 73 | Ex. | 6.23 | 99.0 | A | A | A | A | B |
| No. 74 | Ex. | 5.47 | 99.2 | A | A | A | A | A |
| No. 75 | Comp. Ex. | 3.78 | 96.8 | A | B | C | C | D |
| No. 76 | Comp. Ex. | 4.02 | 96.7 | A | C | C | B | D |
| No. 77 | Comp. Ex. | 3.64 | 96.1 | A | E | E | C | E |
| No. 78 | Comp. Ex. | 4.92 | 95.2 | A | D | D | D | D |
| No. 79 | Comp. Ex. | 4.32 | 95.3 | A | D | D | E | D |
| No. 80 | Comp. Ex. | 4.25 | 96.5 | A | C | C | C | C |

As apparent from Table 8, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

7. Production of Sintered Body (Nb—Ta Based) (Sample Nos. 81 to 90)

Sintered bodies were obtained in the same manner as the method for producing the sintered body of sample No. 1 except that the composition and the like of the metal powder for powder metallurgy were changed as shown in Table 9, respectively.

TABLE 9

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (Nb) mass % | E2 (Ta) | Fe | O | Co | E1/E2 — | E1 + E2 mass % | (E1 + E2)/Si — | Si/Mo — | Remarks — |
| No. 81 | Ex. | 28.46 | 6.12 | 0.74 | 0.182 | 0.013 | 0.08 | 0.15 | 0.09 | 0.28 | remainder | 0.53 | 0.23 | 0.31 | 0.12 | |
| No. 82 | Ex. | 29.68 | 5.38 | 0.57 | 0.154 | 0.028 | 0.05 | 0.11 | 0.12 | 0.33 | remainder | 0.45 | 0.16 | 0.28 | 0.11 | |
| No. 83 | Ex. | 27.36 | 6.91 | 0.84 | 0.218 | 0.038 | 0.12 | 0.16 | 0.23 | 0.38 | remainder | 0.75 | 0.28 | 0.33 | 0.12 | |
| No. 84 | Ex. | 20.45 | 10.48 | 0.72 | 0.033 | 0.021 | 0.14 | 0.25 | 0.11 | 0.22 | remainder | 0.56 | 0.39 | 0.54 | 0.07 | Ni: 35.74<br>Mn: 0.16 |
| No. 85 | Ex. | 19.32 | 0.00 | 0.62 | 0.043 | 0.089 | 0.06 | 0.08 | 0.82 | 0.62 | remainder | 0.75 | 0.14 | 0.23 | — | Ni: 10.12<br>Mn: 1.51<br>W: 15.13 |

TABLE 9-continued

| Sample No. | — | Metal powder for powder metallurgy: Alloy composition: Cr | Mo | Si | N | C | E1 (Nb) mass % | E2 (Ta) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 86 | Comp. Ex. | 28.23 | 5.89 | 0.78 | 0.178 | 0.011 | 0.00 | 0.13 | 0.11 | 0.25 | remainder | 0.00 | 0.13 | 0.17 | 0.13 | |
| No. 87 | Comp. Ex. | 29.73 | 5.38 | 0.53 | 0.157 | 0.028 | 0.10 | 0.00 | 0.17 | 0.41 | remainder | — | 0.10 | 0.19 | 0.10 | |
| No. 88 | Comp. Ex. | 27.40 | 6.79 | 0.85 | 0.234 | 0.052 | 0.00 | 0.00 | 0.29 | 0.34 | remainder | — | 0.00 | 0.00 | 0.13 | |
| No. 89 | Comp. Ex. | 28.63 | 5.76 | 0.72 | 0.123 | 0.078 | 0.81 | 0.11 | 0.25 | 0.18 | remainder | 7.36 | 0.92 | 1.28 | 0.13 | |
| No. 90 | Comp. Ex. | 27.87 | 5.24 | 0.63 | 0.096 | 0.026 | 0.18 | 0.79 | 0.18 | 0.25 | remainder | 0.23 | 0.97 | 1.54 | 0.12 | |

Incidentally, in Table 9, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 9 is omitted.

8. Evaluation of Sintered Body (Nb—Ta Based)

8.1 Evaluation of Relative Density

With respect to the sintered bodies of the respective sample Nos. shown in Table 9, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 10.

8.2 Evaluation of Hardness

With respect to the sintered bodies of the respective sample Nos. shown in Table 9, the Vickers hardness was measured in accordance with the Vickers hardness test method specified in JIS Z 2244 (2009).

Then, the measured hardness was evaluated according to the evaluation criteria described in 2.2.

The evaluation results are shown in Table 10.

8.3 Evaluation of Tensile Strength, 0.2% Proof Stress, and Elongation

With respect to the sintered bodies of the respective sample Nos. shown in Table 9, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 10.

8.4 Evaluation of Fatigue Strength

With respect to the sintered bodies of the respective sample Nos. shown in Table 9, the fatigue strength was measured in the same manner as in 2.4.

Then, the measured fatigue strength was evaluated according to the evaluation criteria described in 2.4.

The evaluation results are shown in Table 10.

TABLE 10

| Sample No. | — | Metal powder: Average particle diameter μm | Evaluation results of sintered body: Relative density % | Vickers hardness — | Tensile strength — | 0.2% proof stress — | Elongation — | Fatigue strength — |
|---|---|---|---|---|---|---|---|---|
| No. 81 | Ex. | 4.35 | 99.0 | A | A | A | A | B |
| No. 82 | Ex. | 3.98 | 98.9 | A | A | A | A | B |
| No. 83 | Ex. | 5.24 | 98.8 | A | A | A | B | B |
| No. 84 | Ex. | 6.25 | 98.6 | A | A | A | B | B |
| No. 85 | Ex. | 5.78 | 98.7 | A | A | A | B | B |
| No. 86 | Comp. Ex. | 4.02 | 96.8 | A | B | C | C | D |
| No. 87 | Comp. Ex. | 4.25 | 96.7 | A | C | C | B | D |
| No. 88 | Comp. Ex. | 3.55 | 96.1 | A | E | E | C | E |
| No. 89 | Comp. Ex. | 5.41 | 95.2 | A | D | D | D | D |
| No. 90 | Comp. Ex. | 5.89 | 95.3 | A | D | D | E | D |

As apparent from Table 10, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

9. Production of Sintered Body (Y—Nb Based)

(Sample Nos. 91 to 100)

Sintered bodies were obtained in the same manner as the method for producing the sintered body of sample No. 1 except that the composition and the like of the metal powder for powder metallurgy were changed as shown in Table 11, respectively.

TABLE 11

| Sample No. | — | Metal powder for powder metallurgy: Alloy composition: Cr | Mo | Si | N | C | E1 (Y) mass % | E2 (Nb) mass % | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 91 | Ex. | 28.51 | 6.11 | 0.74 | 0.192 | 0.012 | 0.12 | 0.13 | 0.08 | 0.21 | remainder | 0.92 | 0.25 | 0.34 | 0.12 | |
| No. 92 | Ex. | 29.69 | 5.42 | 0.54 | 0.157 | 0.026 | 0.07 | 0.05 | 0.25 | 0.31 | remainder | 1.40 | 0.12 | 0.22 | 0.10 | |
| No. 93 | Ex. | 27.41 | 6.88 | 0.87 | 0.234 | 0.037 | 0.18 | 0.24 | 0.16 | 0.39 | remainder | 0.75 | 0.42 | 0.48 | 0.13 | |
| No. 94 | Ex. | 20.35 | 10.28 | 0.73 | 0.031 | 0.026 | 0.08 | 0.09 | 0.13 | 0.25 | remainder | 0.89 | 0.17 | 0.23 | 0.07 | Ni: 35.21<br>Mn: 0.18 |
| No. 95 | Ex. | 19.48 | 0.00 | 0.67 | 0.052 | 0.091 | 0.06 | 0.08 | 0.97 | 0.62 | remainder | 0.75 | 0.14 | 0.21 | — | Ni: 10.12<br>Mn: 1.39<br>W: 14.87 |
| No. 96 | Comp. Ex. | 28.31 | 5.89 | 0.78 | 0.177 | 0.019 | 0.00 | 0.09 | 0.12 | 0.31 | remainder | 0.00 | 0.09 | 0.12 | 0.13 | |
| No. 97 | Comp. Ex. | 29.76 | 5.39 | 0.58 | 0.149 | 0.027 | 0.10 | 0.00 | 0.16 | 0.29 | remainder | — | 0.10 | 0.17 | 0.11 | |
| No. 98 | Comp. Ex. | 27.39 | 6.75 | 0.83 | 0.218 | 0.047 | 0.00 | 0.00 | 0.28 | 0.37 | remainder | — | 0.00 | 0.00 | 0.12 | |
| No. 99 | Comp. Ex. | 28.54 | 5.74 | 0.71 | 0.114 | 0.069 | 0.79 | 0.11 | 0.21 | 0.32 | remainder | 7.18 | 0.90 | 1.27 | 0.12 | |
| No. 100 | Comp. Ex. | 27.68 | 5.28 | 0.63 | 0.098 | 0.031 | 0.15 | 0.81 | 0.19 | 0.17 | remainder | 0.19 | 0.96 | 1.52 | 0.12 | |

Incidentally, in Table 11, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 11 is omitted.

10. Evaluation of Sintered Body (Y—Nb Based)

10.1 Evaluation of Relative Density

With respect to the sintered bodies of the respective sample Nos. shown in Table 11, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 12.

10.2 Evaluation of Hardness

With respect to the sintered bodies of the respective sample Nos. shown in Table 11, the Vickers hardness was measured in accordance with the Vickers hardness test method specified in JIS Z 2244 (2009).

Then, the measured hardness was evaluated according to the evaluation criteria described in 2.2.

The evaluation results are shown in Table 12.

10.3 Evaluation of Tensile Strength, 0.2% Proof Stress, and Elongation

With respect to the sintered bodies of the respective sample Nos. shown in Table 11, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 12.

10.4 Evaluation of Fatigue Strength

With respect to the sintered bodies of the respective sample Nos. shown in Table 11, the fatigue strength was measured in the same manner as in 2.4.

Then, the measured fatigue strength was evaluated according to the evaluation criteria described in 2.4.

The evaluation results are shown in Table 12.

TABLE 12

| Sample No. | — | Metal powder: Average particle diameter μm | Evaluation results of sintered body: Relative density % | Vickers hardness — | Tensile strength — | 0.2% proof stress — | Elongation — | Fatigue strength — |
|---|---|---|---|---|---|---|---|---|
| No. 91 | Ex. | 4.57 | 99.1 | A | A | A | A | A |
| No. 92 | Ex. | 3.64 | 99.0 | A | A | A | A | B |
| No. 93 | Ex. | 5.21 | 98.9 | A | A | A | B | B |
| No. 94 | Ex. | 2.25 | 99.1 | A | A | A | A | B |
| No. 95 | Ex. | 7.69 | 99.0 | A | A | A | A | A |
| No. 96 | Comp. Ex. | 4.65 | 96.7 | A | B | C | C | D |
| No. 97 | Comp. Ex. | 3.54 | 96.6 | A | C | C | B | D |
| No. 98 | Comp. Ex. | 5.32 | 96.1 | A | E | E | C | E |
| No. 99 | Comp. Ex. | 2.21 | 95.2 | A | D | D | D | D |
| No. 100 | Comp. Ex. | 7.88 | 95.3 | A | D | D | E | D |

As apparent from Table 12, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

11. Production of Sintered Body (V—Nb Based)

(Sample Nos. 101 to 110)

Sintered bodies were obtained in the same manner as the method for producing the sintered body of sample No. 1 except that the composition and the like of the metal powder for powder metallurgy were changed as shown in Table 13, respectively.

TABLE 13

| | | Metal powder for powder metallurgy | | | | | | | | | | | | | | |
|---|---|---|---|---|---|---|---|---|---|---|---|---|---|---|---|---|
| | | Alloy composition | | | | | | | | | | | | | | |
| Sample No. | — | Cr | Mo | Si | N | C | E1 (V) mass % | E2 (Nb) | Fe | O | Co | E1/E2 — | E1 + E2 mass % | (E1 + E2)/Si — | Si/Mo — | Remarks — |
| No. 101 | Ex. | 28.54 | 6.14 | 0.76 | 0.189 | 0.015 | 0.08 | 0.13 | 0.08 | 0.18 | remainder | 0.62 | 0.21 | 0.28 | 0.12 | |
| No. 102 | Ex. | 29.64 | 5.38 | 0.53 | 0.154 | 0.031 | 0.05 | 0.09 | 0.23 | 0.29 | remainder | 0.56 | 0.14 | 0.26 | 0.10 | |
| No. 103 | Ex. | 27.36 | 6.79 | 0.89 | 0.221 | 0.036 | 0.15 | 0.22 | 0.15 | 0.37 | remainder | 0.68 | 0.37 | 0.42 | 0.13 | |
| No. 104 | Ex. | 20.33 | 10.25 | 0.73 | 0.028 | 0.024 | 0.03 | 0.08 | 0.13 | 0.25 | remainder | 0.38 | 0.11 | 0.15 | 0.07 | Ni: 35.19<br>Mn: 0.16 |
| No. 106 | Ex. | 19.53 | 0.00 | 0.65 | 0.048 | 0.087 | 0.06 | 0.06 | 0.88 | 0.55 | remainder | 1.00 | 0.12 | 0.18 | — | Ni: 10.01<br>Mn: 1.42<br>W: 15.02 |
| No. 106 | Comp. Ex. | 28.25 | 5.84 | 0.79 | 0.175 | 0.017 | 0.00 | 0.08 | 0.09 | 0.25 | remainder | 0.00 | 0.08 | 0.10 | 0.14 | |
| No. 107 | Comp. Ex. | 29.79 | 5.24 | 0.59 | 0.146 | 0.027 | 0.09 | 0.00 | 0.18 | 0.31 | remainder | — | 0.09 | 0.15 | 0.11 | |
| No. 108 | Comp. Ex. | 27.36 | 6.72 | 0.85 | 0.209 | 0.045 | 0.00 | 0.00 | 0.27 | 0.36 | remainder | — | 0.00 | 0.00 | 0.13 | |
| No. 109 | Comp. Ex. | 28.53 | 5.71 | 0.69 | 0.125 | 0.071 | 0.81 | 0.09 | 0.23 | 0.29 | remainder | 9.00 | 0.90 | 1.30 | 0.12 | |
| No. 110 | Comp. Ex. | 27.61 | 5.24 | 0.65 | 0.102 | 0.029 | 0.10 | 0.78 | 0.18 | 0.21 | remainder | 0.13 | 0.88 | 1.35 | 0.12 | |

Incidentally, in Table 13, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 13 is omitted.

12. Evaluation of Sintered Body (V—Nb Based)

12.1 Evaluation of Relative Density

With respect to the sintered bodies of the respective sample Nos. shown in Table 13, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 14.

12.2 Evaluation of Hardness

With respect to the sintered bodies of the respective sample Nos. shown in Table 13, the Vickers hardness was measured in accordance with the Vickers hardness test method specified in JIS Z 2244 (2009).

Then, the measured hardness was evaluated according to the evaluation criteria described in 2.2.

The evaluation results are shown in Table 14.

12.3 Evaluation of Tensile Strength, 0.2% Proof Stress, and Elongation

With respect to the sintered bodies of the respective sample Nos. shown in Table 13, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 14.

12.4 Evaluation of Fatigue Strength

With respect to the sintered bodies of the respective sample Nos. shown in Table 13, the fatigue strength was measured in the same manner as in 2.4.

Then, the measured fatigue strength was evaluated according to the evaluation criteria described in 2.4.

The evaluation results are shown in Table 14.

TABLE 14

| | | Metal powder | Evaluation results of sintered body | | | | | |
|---|---|---|---|---|---|---|---|---|
| Sample No. | — | Average particle diameter μm | Relative density % | Vickers hardness — | Tensile strength — | 0.2% proof stress — | Elongation — | Fatigue strength — |
| No. 101 | Ex. | 4.45 | 99.0 | A | A | A | A | B |
| No. 102 | Ex. | 3.64 | 98.9 | A | A | A | A | B |
| No. 103 | Ex. | 4.25 | 98.7 | A | A | A | B | B |
| No. 104 | Ex. | 3.58 | 98.9 | A | A | A | B | B |
| No. 106 | Ex. | 3.69 | 98.8 | A | A | A | B | B |

TABLE 14-continued

| Sample No. | — | Metal powder Average particle diameter μm | Evaluation results of sintered body Relative density % | Vickers hardness — | Tensile strength — | 0.2% proof stress — | Elongation — | Fatigue strength — |
|---|---|---|---|---|---|---|---|---|
| No. 106 | Comp. Ex. | 3.96 | 96.5 | A | B | C | C | D |
| No. 107 | Comp. Ex. | 4.21 | 96.6 | A | C | C | B | D |
| No. 108 | Comp. Ex. | 3.57 | 96.2 | A | E | E | C | E |
| No. 109 | Comp. Ex. | 5.21 | 95.4 | A | D | D | D | D |
| No. 110 | Comp. Ex. | 5.36 | 95.5 | A | D | D | E | D |

As apparent from Table 14, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

13. Production of Sintered Body (Ti—Zr Based)

(Sample Nos. 111 to 120)

Sintered bodies were obtained in the same manner as the method for producing the sintered body of sample No. 1 except that the composition and the like of the metal powder for powder metallurgy were changed as shown in Table 15, respectively.

TABLE 15

| Sample No. | — | Metal powder for powder metallurgy: Alloy composition Cr | Mo | Si | N | C | E1 (Ti) mass % | E2 (Zr) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 111 | Ex. | 28.48 | 6.09 | 0.78 | 0.191 | 0.014 | 0.07 | 0.12 | 0.09 | 0.21 | remainder | 0.58 | 0.19 | 0.24 | 0.13 | |
| No. 112 | Ex. | 29.71 | 5.29 | 0.52 | 0.153 | 0.029 | 0.04 | 0.08 | 0.22 | 0.31 | remainder | 0.50 | 0.12 | 0.23 | 0.10 | |
| No. 113 | Ex. | 27.34 | 6.74 | 0.86 | 0.225 | 0.037 | 0.16 | 0.20 | 0.16 | 0.36 | remainder | 0.80 | 0.36 | 0.42 | 0.13 | |
| No. 114 | Ex. | 20.29 | 10.22 | 0.74 | 0.031 | 0.026 | 0.03 | 0.06 | 0.14 | 0.24 | remainder | 0.50 | 0.09 | 0.12 | 0.07 | Ni: 35.26 Mn: 0.14 |
| No. 115 | Ex. | 19.48 | 0.00 | 0.63 | 0.051 | 0.085 | 0.05 | 0.06 | 0.86 | 0.54 | remainder | 0.83 | 0.11 | 0.17 | — | Ni: 9.87 Mn: 1.51 W: 14.89 |
| No. 116 | Comp. Ex. | 28.31 | 5.79 | 0.76 | 0.178 | 0.015 | 0.00 | 0.12 | 0.08 | 0.26 | remainder | 0.00 | 0.12 | 0.16 | 0.13 | |
| No. 117 | Comp. Ex. | 29.75 | 5.21 | 0.56 | 0.138 | 0.029 | 0.08 | 0.00 | 0.16 | 0.29 | remainder | — | 0.08 | 0.14 | 0.11 | |
| No. 118 | Comp. Ex. | 27.40 | 6.74 | 0.83 | 0.215 | 0.046 | 0.00 | 0.00 | 0.29 | 0.29 | remainder | — | 0.00 | 0.00 | 0.12 | |
| No. 119 | Comp. Ex. | 28.59 | 5.73 | 0.66 | 0.129 | 0.074 | 0.78 | 0.11 | 0.24 | 0.31 | remainder | 7.09 | 0.89 | 1.35 | 0.12 | |
| No. 120 | Comp. Ex. | 27.63 | 5.26 | 0.63 | 0.096 | 0.027 | 0.10 | 0.82 | 0.16 | 0.19 | remainder | 0.12 | 0.92 | 1.46 | 0.12 | |

Incidentally, in Table 15, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 15 is omitted.

14. Evaluation of Sintered Body (Ti—Zr Based)

14.1 Evaluation of Relative Density

With respect to the sintered bodies of the respective sample Nos. shown in Table 15, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 16.

14.2 Evaluation of Hardness

With respect to the sintered bodies of the respective sample Nos. shown in Table 15, the Vickers hardness was measured in accordance with the Vickers hardness test method specified in JIS Z 2244 (2009).

Then, the measured hardness was evaluated according to the evaluation criteria described in 2.2.

The evaluation results are shown in Table 16.

14.3 Evaluation of Tensile Strength, 0.2% Proof Stress, and Elongation

With respect to the sintered bodies of the respective sample Nos. shown in Table 15, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 16.

14.4 Evaluation of Fatigue Strength

With respect to the sintered bodies of the respective sample Nos. shown in Table 15, the fatigue strength was measured in the same manner as in 2.4.

Then, the measured fatigue strength was evaluated according to the evaluation criteria described in 2.4.

The evaluation results are shown in Table 16.

TABLE 16

| Sample No. | — | Metal powder: Average particle diameter μm | Evaluation results of sintered body: Relative density % | Vickers hardness — | Tensile strength — | 0.2% proof stress — | Elongation — | Fatigue strength — |
|---|---|---|---|---|---|---|---|---|
| No. 111 | Ex. | 4.23 | 98.9 | A | A | A | A | A |
| No. 112 | Ex. | 3.69 | 98.7 | A | A | A | A | A |
| No. 113 | Ex. | 5.84 | 98.8 | A | A | A | B | B |
| No. 114 | Ex. | 2.05 | 98.7 | A | A | A | B | B |
| No. 115 | Ex. | 3.69 | 98.8 | A | A | A | A | A |
| No. 116 | Comp. Ex. | 3.99 | 96.7 | A | B | C | C | D |
| No. 117 | Comp. Ex. | 4.66 | 96.5 | A | C | C | B | D |
| No. 118 | Comp. Ex. | 3.12 | 96.0 | A | E | E | C | E |
| No. 119 | Comp. Ex. | 5.26 | 95.2 | A | D | D | D | D |
| No. 120 | Comp. Ex. | 4.25 | 95.4 | A | D | D | E | D |

As apparent from Table 16, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

9. Production of Sintered Body (Zr—Ta Based)

(Sample Nos. 121 to 130)

Sintered bodies were obtained in the same manner as the method for producing the sintered body of sample No. 1 except that the composition and the like of the metal powder for powder metallurgy were changed as shown in Table 17, respectively.

16. Evaluation of Sintered Body (Zr—Ta Based)

16.1 Evaluation of Relative Density

With respect to the sintered bodies of the respective sample Nos. shown in Table 17, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 18.

16.2 Evaluation of Hardness

With respect to the sintered bodies of the respective sample Nos. shown in Table 17, the Vickers hardness was measured in accordance with the Vickers hardness test method specified in JIS Z 2244 (2009).

Then, the measured hardness was evaluated according to the evaluation criteria described in 2.2.

The evaluation results are shown in Table 18.

16.3 Evaluation of Tensile Strength, 0.2% Proof Stress, and Elongation

TABLE 17

| Sample No. | — | Metal powder for powder metallurgy: Alloy composition: Cr | Mo | Si | N | C | E1 (Zr) mass % | E2 (Ta) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 121 | Ex. | 28.54 | 6.12 | 0.76 | 0.187 | 0.012 | 0.07 | 0.12 | 0.09 | 0.21 | remainder | 0.58 | 0.19 | 0.25 | 0.12 | |
| No. 122 | Ex. | 29.75 | 5.31 | 0.54 | 0.156 | 0.031 | 0.05 | 0.11 | 0.18 | 0.29 | remainder | 0.45 | 0.16 | 0.30 | 0.10 | |
| No. 123 | Ex. | 27.31 | 6.78 | 0.87 | 0.218 | 0.036 | 0.12 | 0.18 | 0.15 | 0.34 | remainder | 0.67 | 0.30 | 0.34 | 0.13 | |
| No. 124 | Ex. | 20.31 | 10.18 | 0.76 | 0.032 | 0.024 | 0.04 | 0.08 | 0.19 | 0.25 | remainder | 0.50 | 0.12 | 0.16 | 0.07 | Ni: 35.05<br>Mn: 0.16 |
| No. 125 | Ex. | 19.42 | 0.00 | 0.62 | 0.048 | 0.082 | 0.06 | 0.06 | 0.79 | 0.48 | remainder | 1.00 | 0.12 | 0.19 | — | Ni: 10.03<br>Mn: 1.47<br>W: 14.82 |
| No. 126 | Comp. Ex. | 28.35 | 5.74 | 0.78 | 0.175 | 0.016 | 0.00 | 0.11 | 0.07 | 0.27 | remainder | 0.00 | 0.11 | 0.14 | 0.14 | |
| No. 127 | Comp. Ex. | 29.78 | 5.24 | 0.55 | 0.136 | 0.027 | 0.09 | 0.00 | 0.14 | 0.31 | remainder | — | 0.09 | 0.16 | 0.10 | |
| No. 128 | Comp. Ex. | 27.36 | 6.78 | 0.84 | 0.221 | 0.042 | 0.00 | 0.00 | 0.27 | 0.26 | remainder | — | 0.00 | 0.00 | 0.12 | |
| No. 129 | Comp. Ex. | 28.56 | 5.78 | 0.65 | 0.127 | 0.071 | 0.75 | 0.11 | 0.23 | 0.29 | remainder | 6.82 | 0.86 | 1.32 | 0.11 | |
| No. 130 | Comp. Ex. | 27.61 | 5.24 | 0.61 | 0.093 | 0.027 | 0.12 | 0.89 | 0.18 | 0.20 | remainder | 0.13 | 1.01 | 1.66 | 0.12 | |

Incidentally, in Table 17, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 17 is omitted.

With respect to the sintered bodies of the respective sample Nos. shown in Table 17, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 18.

16.4 Evaluation of Fatigue Strength

With respect to the sintered bodies of the respective sample Nos. shown in Table 17, the fatigue strength was measured in the same manner as in 2.4.

Then, the measured fatigue strength was evaluated according to the evaluation criteria described in 2.4.

The evaluation results are shown in Table 18.

TABLE 18

| Sample No. | — | Metal powder Average particle diameter μm | Evaluation results of sintered body Relative density % | Vickers hardness — | Tensile strength — | 0.2% proof stress — | Elongation — | Fatigue strength — |
|---|---|---|---|---|---|---|---|---|
| No. 121 | Ex. | 3.97 | 99.1 | A | A | A | A | A |
| No. 122 | Ex. | 5.24 | 99.0 | A | A | A | A | A |
| No. 123 | Ex. | 6.78 | 99.2 | A | A | A | B | B |
| No. 124 | Ex. | 1.89 | 99.0 | A | A | A | A | B |
| No. 125 | Ex. | 9.86 | 99.0 | A | A | A | A | B |
| No. 126 | Comp. Ex. | 3.75 | 96.8 | A | B | C | C | D |
| No. 127 | Comp. Ex. | 4.12 | 96.4 | A | C | C | B | D |
| No. 128 | Comp. Ex. | 3.88 | 95.8 | A | E | E | C | E |
| No. 129 | Comp. Ex. | 5.24 | 95.9 | A | D | D | D | D |
| No. 130 | Comp. Ex. | 5.12 | 95.9 | A | D | D | E | D |

As apparent from Table 18, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

17. Production of Sintered Body (Zr—V Based) (Sample Nos. 131 to 140)

Sintered bodies were obtained in the same manner as the method for producing the sintered body of sample No. 1 except that the composition and the like of the metal powder for powder metallurgy were changed as shown in Table 19, respectively.

Incidentally, in Table 19, among the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities, but the description thereof in Table 19 is omitted.

18. Evaluation of Sintered Body (Zr—V Based)

18.1 Evaluation of Relative Density

With respect to the sintered bodies of the respective sample Nos. shown in Table 19, the sintered density was measured in accordance with the method for measuring the density of sintered metal materials specified in JIS Z 2501 (2000), and also the relative density of each sintered body was calculated with reference to the true density of the metal powder for powder metallurgy used for producing each sintered body.

The calculation results are shown in Table 20.

18.2 Evaluation of Hardness

With respect to the sintered bodies of the respective sample Nos. shown in Table 19, the Vickers hardness was measured in accordance with the Vickers hardness test method specified in JIS Z 2244 (2009).

Then, the measured hardness was evaluated according to the evaluation criteria described in 2.2.

The evaluation results are shown in Table 20.

TABLE 19

| Sample No. | — | Metal powder for powder metallurgy: Alloy composition Cr | Mo | Si | N | C | E1 (Zr) mass % | E2 (V) | Fe | O | Co | E1/E2 — | E1 + E2 mass % | (E1 + E2)/Si — | Si/Mo — | Remarks — |
|---|---|---|---|---|---|---|---|---|---|---|---|---|---|---|---|---|
| No. 131 | Ex. | 28.56 | 6.18 | 0.74 | 0.183 | 0.016 | 0.12 | 0.08 | 0.09 | 0.21 | remainder | 1.50 | 0.20 | 0.27 | 0.12 | |
| No. 132 | Ex. | 29.72 | 5.28 | 0.55 | 0.153 | 0.028 | 0.08 | 0.07 | 0.13 | 0.29 | remainder | 1.14 | 0.15 | 0.27 | 0.10 | |
| No. 133 | Ex. | 27.28 | 6.68 | 0.88 | 0.209 | 0.034 | 0.18 | 0.12 | 0.14 | 0.35 | remainder | 1.50 | 0.30 | 0.34 | 0.13 | |
| No. 134 | Ex. | 20.34 | 10.08 | 0.72 | 0.036 | 0.030 | 0.08 | 0.04 | 0.21 | 0.24 | remainder | 2.00 | 0.12 | 0.17 | 0.07 | Ni: 35.12<br>Mn: 0.13 |
| No. 135 | Ex. | 19.36 | 0.00 | 0.64 | 0.045 | 0.078 | 0.06 | 0.07 | 0.79 | 0.46 | remainder | 0.86 | 0.13 | 0.20 | — | Ni: 10.03<br>Mn: 1.47<br>W: 14.82 |
| No. 136 | Comp. Ex. | 28.31 | 5.58 | 0.76 | 0.173 | 0.014 | 0.00 | 0.09 | 0.09 | 0.25 | remainder | 0.00 | 0.09 | 0.12 | 0.14 | |
| No. 137 | Comp. Ex. | 29.76 | 5.21 | 0.53 | 0.134 | 0.027 | 0.10 | 0.00 | 0.16 | 0.32 | remainder | — | 0.10 | 0.19 | 0.10 | |
| No. 138 | Comp. Ex. | 27.41 | 6.75 | 0.85 | 0.219 | 0.043 | 0.00 | 0.00 | 0.28 | 0.26 | remainder | — | 0.00 | 0.00 | 0.13 | |
| No. 139 | Comp. Ex. | 28.65 | 5.71 | 0.64 | 0.128 | 0.073 | 0.78 | 0.12 | 0.24 | 0.28 | remainder | 6.50 | 0.90 | 1.41 | 0.11 | |
| No. 140 | Comp. Ex. | 27.65 | 5.26 | 0.63 | 0.093 | 0.026 | 0.11 | 0.84 | 0.17 | 0.22 | remainder | 0.13 | 0.95 | 1.51 | 0.12 | |

18.3 Evaluation of Tensile Strength, 0.2% Proof Stress, and Elongation

With respect to the sintered bodies of the respective sample Nos. shown in Table 19, the tensile strength, 0.2% proof stress, and elongation were measured in accordance with the metal material tensile test method specified in JIS Z 2241 (2011).

Then, the measured physical property values were evaluated according to the evaluation criteria described in 2.3.

The evaluation results are shown in Table 20.

18.4 Evaluation of Fatigue Strength

With respect to the sintered bodies of the respective sample Nos. shown in Table 19, the fatigue strength was measured in the same manner as in 2.4.

Then, the measured fatigue strength was evaluated according to the evaluation criteria described in 2.4.

The evaluation results are shown in Table 20.

TABLE 20

| Sample No. | — | Metal powder Average particle diameter μm | Evaluation results of sintered body Relative density % | Vickers hardness — | Tensile strength — | 0.2% proof stress — | Elongation — | Fatigue strength — |
|---|---|---|---|---|---|---|---|---|
| No. 131 | Ex. | 4.56 | 99.1 | A | A | A | A | A |
| No. 132 | Ex. | 3.05 | 99.0 | A | A | A | A | B |
| No. 133 | Ex. | 5.87 | 98.9 | A | A | A | B | B |
| No. 134 | Ex. | 2.23 | 98.9 | A | A | A | A | B |
| No. 135 | Ex. | 10.24 | 99.0 | A | A | A | A | B |
| No. 136 | Comp. Ex. | 4.51 | 96.5 | A | B | C | C | D |
| No. 137 | Comp. Ex. | 4.36 | 96.8 | A | C | C | B | D |
| No. 138 | Comp. Ex. | 3.29 | 96.0 | A | E | E | D | E |
| No. 139 | Comp. Ex. | 5.24 | 95.3 | A | D | D | D | D |
| No. 140 | Comp. Ex. | 5.36 | 95.4 | A | D | D | E | D |

As apparent from Table 20, it was confirmed that the sintered bodies corresponding to Example each have a higher relative density than the sintered bodies corresponding to Comparative Example. It was also confirmed that there is a significant difference in properties such as tensile strength, 0.2% proof stress, and elongation between them.

19. Evaluation of Specularity of Sintered Body 19.1 Evaluation of Porosity Near Surface and Inside First, each of the sintered bodies of the respective sample Nos. shown in Table 21 was cut and the cross section was polished.

Subsequently, a porosity A1 near the surface of the sintered body and a porosity A2 inside the sintered body were calculated and also A2-A1 was calculated.

The above calculation results are shown in Table 21.

19.2 Evaluation of Specular Gloss

First, each of the sintered bodies of the sample Nos. shown in Table 21 was subjected to a barrel polishing treatment.

Subsequently, the specular gloss of the sintered body was measured in accordance with the method for measuring the specular gloss specified in JIS Z 8741 (1997). The incident angle of light with respect to the surface of the sintered body was set to 60°, and as a reference plane for calculating the specular gloss, a glass having a specular gloss of 90 and a refractive index of 1.500 was used. Then, the measured specular gloss was evaluated according to the following evaluation criteria.

<Evaluation Criteria for Specular Gloss>

A: The specularity of the surface is very high (the specular gloss is 200 or more).

B: The specularity of the surface is high (the specular gloss is 150 or more and less than 200).

C: The specularity of the surface is somewhat high (the specular gloss is 100 or more and less than 150).

D: The specularity of the surface is somewhat low (the specular gloss is 60 or more and less than 100).

E: The specularity of the surface is low (the specular gloss is 30 or more and less than 60).

F: The specularity of the surface is very low (the specular gloss is less than 30).

The above evaluation results are shown in Table 21.

TABLE 21

| Sample No. | Ex./Comp. Ex. | Alloy composition E1 | E2 | Evaluation results A2-A1 [%] | Specular gloss |
|---|---|---|---|---|---|
| 1 | Ex. | Zr | Nb | 0.9 | A |
| 17 | Comp. Ex. | | | 0.1 | E |
| 41 | Ex. | Hf | Nb | 0.8 | A |
| 57 | Comp. Ex. | | | 0.1 | E |
| 70 | Ex. | Ti | Nb | 1.0 | A |
| 75 | Comp. Ex. | | | 0.2 | E |
| 81 | Ex. | Nb | Ta | 0.4 | C |
| 86 | Comp. Ex. | | | 0.1 | E |
| 91 | Ex. | Y | Nb | 1.1 | A |
| 96 | Comp. Ex. | | | 0.1 | E |
| 101 | Ex. | V | Nb | 0.8 | C |
| 106 | Comp. Ex. | | | 0.2 | E |
| 111 | Ex. | Ti | Zr | 0.5 | C |
| 116 | Comp. Ex. | | | 0.1 | E |
| 121 | Ex. | Zr | Ta | 0.7 | B |
| 126 | Comp. Ex. | | | 0.1 | E |
| 131 | Ex. | Zr | V | 0.7 | B |
| 136 | Comp. Ex. | | | 0.1 | E |

As apparent from Table 21, it was confirmed that the sintered bodies corresponding to Example each have a higher specular gloss than the sintered bodies corresponding to Comparative Example. This is considered to be because the porosity near the surface of the sintered body is particularly low, and therefore, light scattering is suppressed, however, the ratio of regular reflection is increased.

The invention claimed is:

1. A metal powder for powder metallurgy, comprising:
Co as a principal component;
Cr in a proportion of 27 mass % or more and 34 mass % or less; and
Si in a proportion of 0.3 mass % or more and 2.0 mass % or less;
Hf in a proportion of 0.01 mass % or more and 0.5 mass % or less; and
Nb in a proportion of 0.01 mass % or more and 0.5 mass % or less.

2. The metal powder for powder metallurgy according to claim 1, further comprising Mo in a proportion of 3 mass % or more and 12 mass % or less.

3. The metal powder for powder metallurgy according to claim 1, further comprising N in a proportion of 0.09 mass % or more and 0.5 mass % or less.

4. The metal powder for powder metallurgy according to claim 1, wherein when a value obtained by dividing the content of Nb by the mass number of Nb is represented by X2 and a value obtained by dividing the content of Hf by the mass number of Hf is represented by X1, X1/X2 is 0.3 or more and 3 or less.

5. The metal powder for powder metallurgy according to claim 1, wherein the sum of the content of the first element and the content of the second element is 0.05 mass % or more and 0.6 mass % or less.

6. The metal powder for powder metallurgy according to claim 1, wherein the metal powder has an average particle diameter of 0.5 μm or more and 30 μm or less.

7. A compound, comprising the metal powder for powder metallurgy according to claim 1 and a binder which binds the particles of the metal powder for powder metallurgy to one another.

8. A granulated powder, comprising the metal powder for powder metallurgy according to claim 1.

9. The metal powder for powder metallurgy according to claim 1, wherein a content of the Hf is defined as E1, a content of the Nb is defined as E2, and a ratio of a sum of the content of E1 and the content of E2 to a content of Si is represented by (E1+E2)/Si, the ratio of (E1+E2)/Si is 0.15 or more and 0.7 or less.

* * * * *